US010914157B2

(12) United States Patent
Hassard

(10) Patent No.: US 10,914,157 B2
(45) Date of Patent: Feb. 9, 2021

(54) MILL-RIGHT SYSTEM

(71) Applicant: Coil Solutions, Inc., Calgary (CA)

(72) Inventor: Cecil Hassard, Calgary (CA)

(73) Assignee: Coil Solutions, Inc., Calgary (CA)

( * ) Notice: Subject to any disclaimer, the term of this patent is extended or adjusted under 35 U.S.C. 154(b) by 281 days.

(21) Appl. No.: 15/778,431

(22) PCT Filed: Nov. 23, 2016

(86) PCT No.: PCT/CA2016/051373

§ 371 (c)(1),
(2) Date: May 23, 2018

(87) PCT Pub. No.: WO2017/088052

PCT Pub. Date: Jun. 1, 2017

(65) Prior Publication Data

US 2018/0340409 A1 Nov. 29, 2018

Related U.S. Application Data

(60) Provisional application No. 62/258,960, filed on Nov. 23, 2015.

(51) Int. Cl.

| | |
|---|---|
| ***E21B 44/02*** | (2006.01) |
| ***E21B 29/00*** | (2006.01) |
| *E21B 29/04* | (2006.01) |

(52) U.S. Cl.
CPC ..... *E21B 44/02* (2013.01); *E21B 29/00* (2013.01); *E21B 29/002* (2013.01); *E21B 29/04* (2013.01)

(58) Field of Classification Search
CPC ..... E21B 44/02; E21B 44/00; E21B 29/00; E21B 29/002; E21B 29/04
See application file for complete search history.

(56) References Cited

U.S. PATENT DOCUMENTS

2015/0300153 A1* 10/2015 MacDonald ..... E21B 17/20 166/66

OTHER PUBLICATIONS

International Search Report and Written Opinion dated Mar. 1, 2017, in International Application No. PCT/CA16/51373.

* cited by examiner

*Primary Examiner* — Michael R Wills, III
(74) *Attorney, Agent, or Firm* — Ramey & Schwaller LLP; William P. Ramey; Melissa D. Schwaller

(57) ABSTRACT

The Mill-Right system is a hydraulic control system that optimizes drilling performance by controlling speed and force at the drill bit. It controls 3 drilling parameters through integrated software. 1) Weight on Bit (WOB); 2) Rate of Penetration (ROP); and 3) Differential Pressure (DP).

16 Claims, 24 Drawing Sheets

20

MILL-RIGHT SYSTEM

CROSS-REFERENCE TO RELATED APPLICATIONS

This application is a National Stage filing of International Application No. PCT/CA2016/051373, filed Nov. 23, 2016; which claims benefit of U.S. Provisional Application No. 62/258,960, filed Nov. 23, 2015.

FIELD

The disclosure relates generally to oil production. The disclosure relates specifically to controlling the movement of an injector used in coiled-tubing applications, such as coiled tubing drilling.

BACKGROUND

When tools or damaged casing fall into the wellbore while drilling, fishing and cleanup is required to remove the obstruction. Mill bits can be used to drill through the obstruction. This process is both time-consuming and financially expensive.

It would be advantageous to have a system that controls the milling operation of a coiled-tubing drilling system with the capability to monitor all or a combination of the parameters weight on bit, rate of penetration, and pressure differential in order to increase drill bit and motor life to limit the amount of time and money utilized during the process. It would also be advantageous to have a system that is capable of reacting to changes quicker.

SUMMARY

An embodiment of the disclosure is an apparatus for improving drilling performance of a coiled-tubing system during milling, wherein the coiled-tubing system includes an injector coupled to a pair of hydraulic motors. The apparatus comprises at least one closed loop electro-proportional valve coupleable to the pair of hydraulic motors; at least one Discrete solenoid valve; at least five Cartridge valves; at least one Small pressure filter couplable to the injector; and at least three Pressure feedback devices; wherein software is integrated with the components of the apparatus and couplable to the injector and the pair of hydraulic motors; wherein the apparatus performs at least one selected from the group consisting of controlling the weight on the drill bit, controlling the rate of penetration, and controlling the differential pressure. In an embodiment, the closed loop electro-proportional valve controls the injector motor, i.e., the pair of hydraulic motors, while milling. In an embodiment, the discrete solenoid valve enables the apparatus. In an embodiment, the cartridge valves isolate the apparatus and override control valves for integration with the existing closed loop circuit. In an embodiment, the small pressure filter is for apparatus supply filtration of hydraulic fluid. In an embodiment, the pressure feedback devices are transducers mounted remotely from a manifold. In an embodiment, the manifold is mounted to an injector frame that houses the injector, wherein the manifold is for hydraulic control of the apparatus. In an embodiment, a human-machine interface provides for user input to the apparatus and display of information to the user. An embodiment further comprises bulkhead provisions for pressure supply and low pressure return for the control manifold; a pressure filter to protect against contamination; at least one small accumulator; plumbing remote mounted from manifold; a wiring harness from a human-machine interface to an injector junction box; and wiring from the injector junction box to devices.

An embodiment of the disclosure is a method of improving drill performance during coiled-tubing milling comprising using the apparatus above; wherein the speed of the drill bit is controlled; wherein the force on the drill bit is controlled; wherein the drill bit is a milling drill bit; wherein the output to the proportional valve is adjusted to provide control. An embodiment further comprises moving the milling tool to the bottom of a hole. An embodiment further comprises setting maximum values for the weight on the drill bit (i.e., the force on the drill bit), rate of penetration of the drill bit, and differential pressure across the well head. In an embodiment, the apparatus shuts down if any of the maximum values are exceeded. In an embodiment, controlling the weight on the drill bit, controlling the rate of penetration, and controlling the differential pressure are performed simultaneously. In an embodiment, two of the group consisting of controlling the weight on the drill bit, controlling the rate of penetration, and controlling the differential pressure are activated simultaneously. In an embodiment, the apparatus is installed on an existing coil tubing injector head. In an embodiment, the apparatus is installed on a new coil tubing injector head. In an embodiment, an operator selects a milling mode. In an embodiment, the rate of penetration is controlled by adjusting a flow rate by adjusting a swash plate in a hydraulic motor to allow an injector drive chain to speed up. In an embodiment, hydraulic pressure is adjusted to control the weight on the bit.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

The disclosed apparatus, or Mill-Right system, improves the performance of the injector of a coiled-tubing system because it controls the injector's forward movement by monitoring the weight on bit and adjusting the hydraulic pressure up and down as needed to keep a constant weight on the bit. The rate of penetration adjusts flow rate by adjusting the swash plate in the hydraulic motors to allow the injector drive chains to speed up or slow down as per the set parameters of the Mill-Right system to allow for control rate of penetration. The well head pressure differential is monitored so that the fluid pump can be throttled up and down to meet the set parameters of the Mill-Right system to keep the pressure differential constant. The auto-miller acts as a relief valve controlling the injector.

Figure 1:
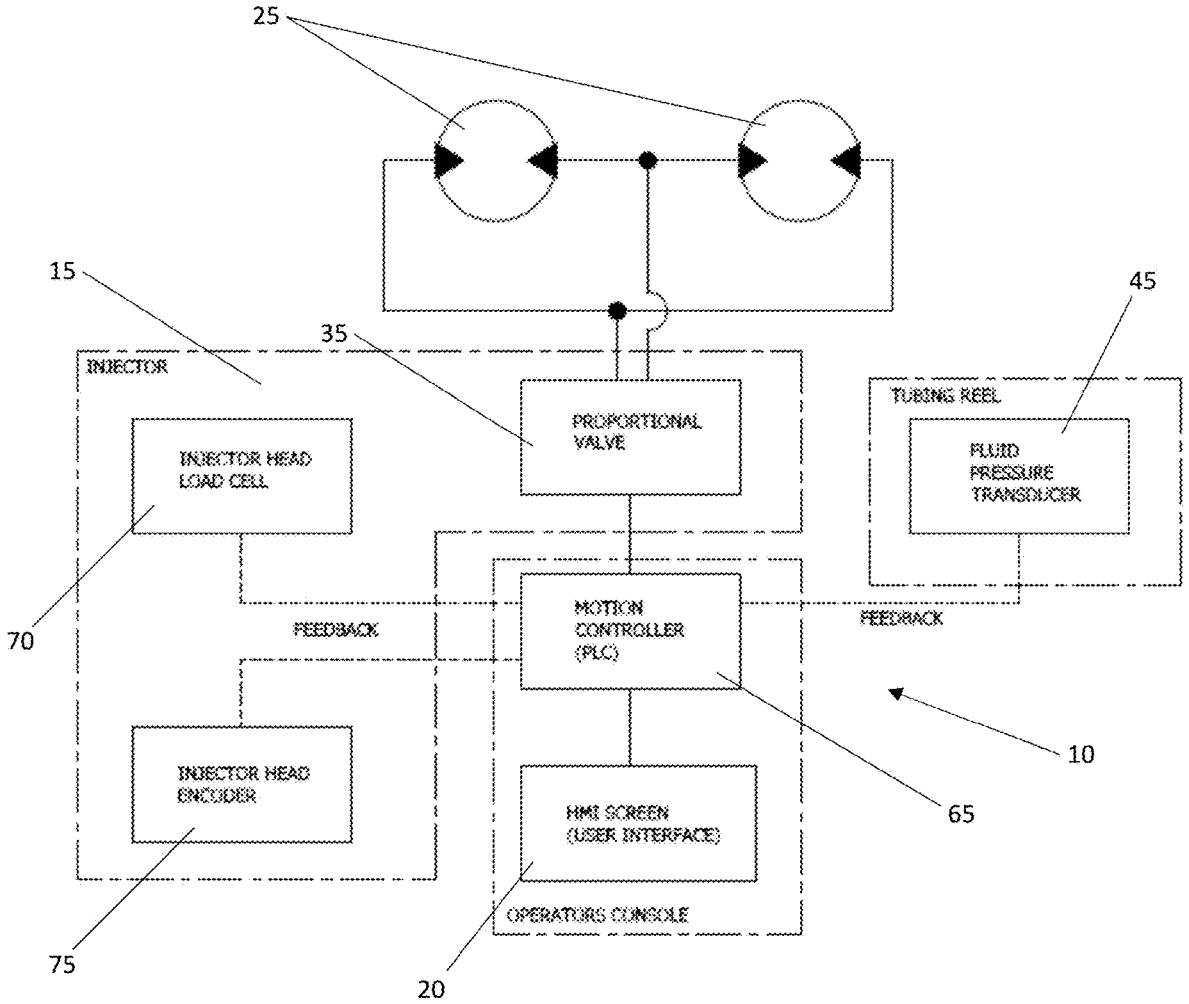
FIG. 1 depicts a chart of the basic layout of the mill-right system.
Figure 21:
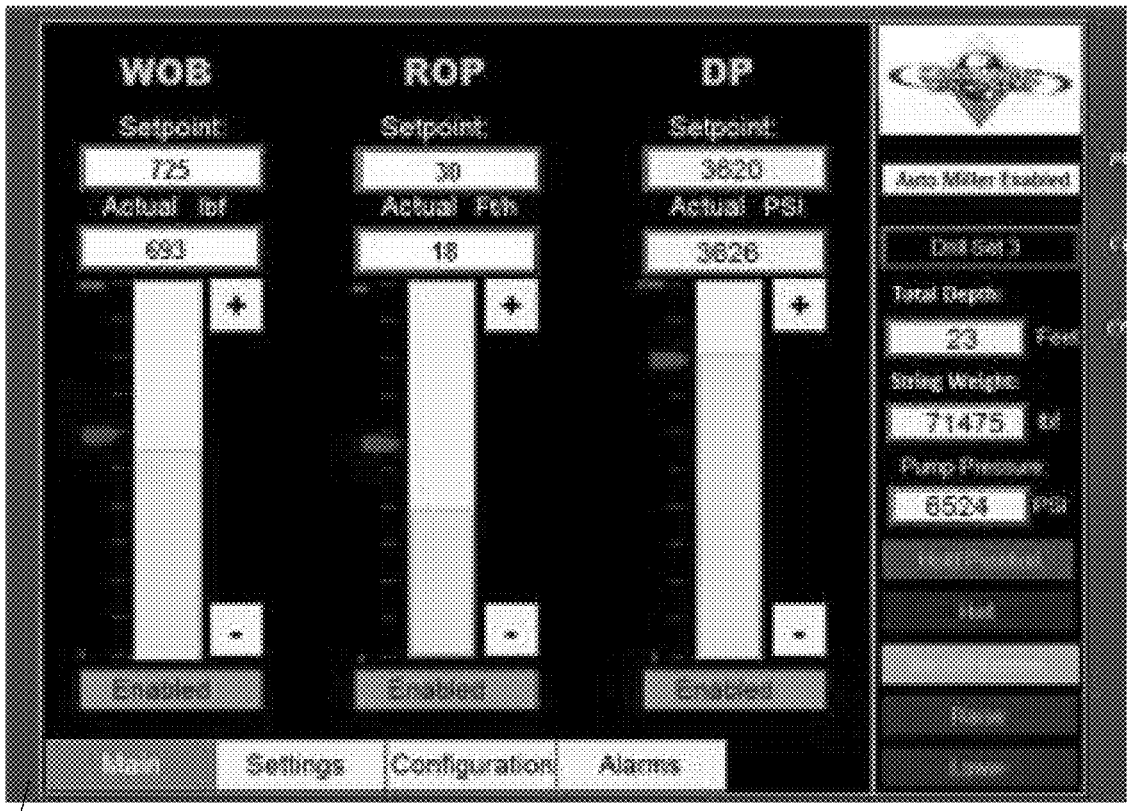
FIG. 21 depicts a screen for the mill-right system.
Figure 22:
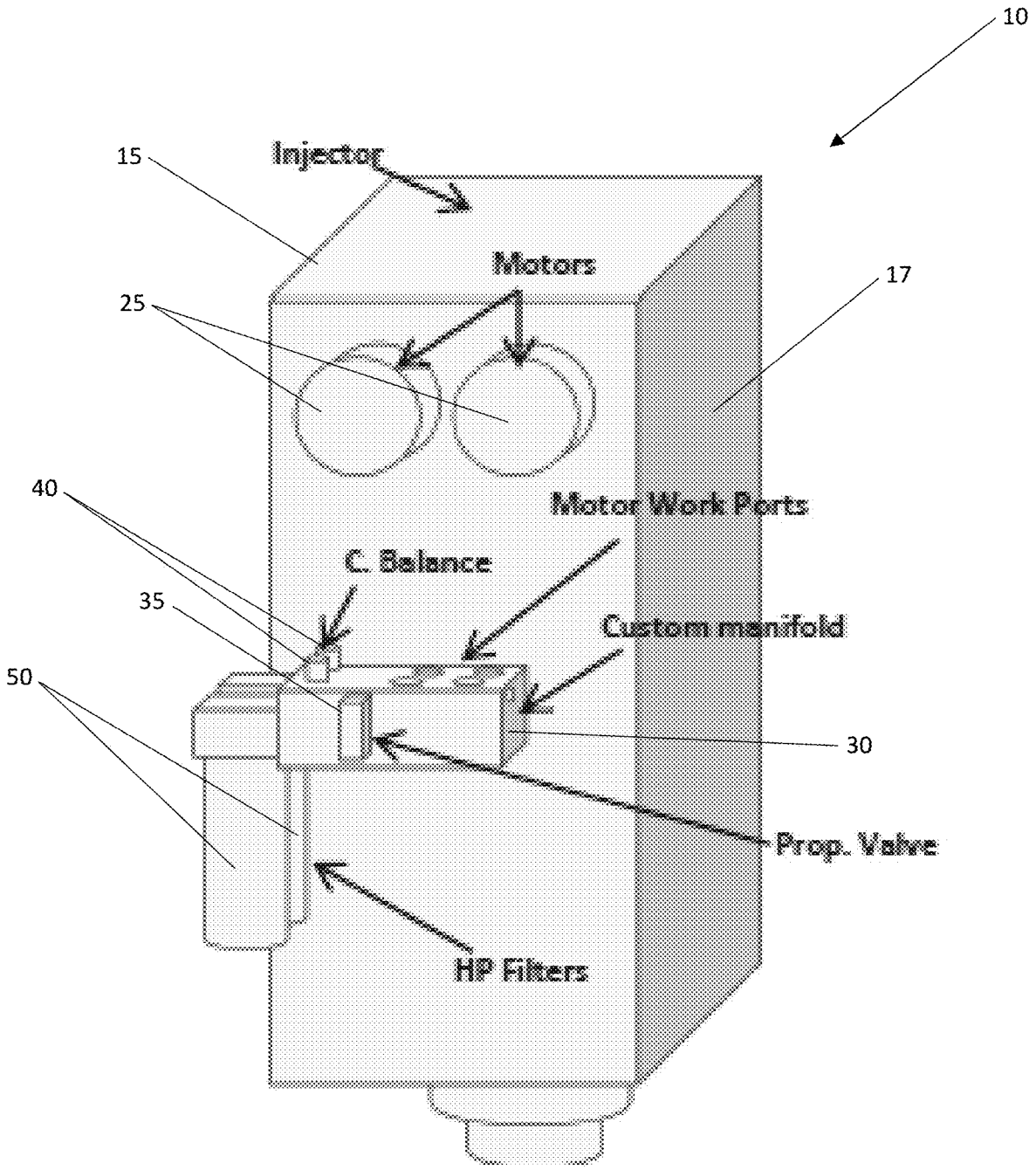
FIG. 22 depicts an injector for the mill-right system.

The apparatus or Mill-Right system 10 is a hydraulic control system that optimizes drilling performance by accurately controlling speed and force at the drill bit. It can be installed on existing and new coil tubing injector heads 15. FIGS. 1 and 22. It provides precise automated milling by touching buttons on a Human Machine Interface (HMI) screen 20 in FIGS. 3, 21 and other figures.

In an embodiment, hydraulic pressure or flow is converted into an electronic signal in order to have the hydraulic system react quicker to changes in pressure and flow requirements of the injector drive motors 25. In an embodiment, this is achieved by monitoring the weight on bit, rate of penetration, and the pressure differential. In an embodiment, the parameters weight on bit, rate of penetration, and the pressure differential are monitored together as set points. In an embodiment, any combination of these parameters can be used to operate the control system 10. In an embodiment, an electronic signal is converted to a hydraulic signal or a hydraulic signal is converted to an electronic signal depending on the set point of the operating system. In an embodiment, it is a benefit that the system is able to look at more than weight on bit.

The apparatus or system 10 precisely controls three drilling parameters, or three parameter set points, through integrated software.

Weight on Bit (WOB)

Rate of Penetration (ROP)

Differential Pressure (DP)

One, two or all three methods can be active simultaneously to optimize penetration rates. The features and benefits of the Mill-Right system 10 are 1) Uniform weight on drill bit therefore increasing drill bit life; and 2) Constant mud pump pressure, which reduces shock and therefore eliminates stalling of the motor for longer motor life and reduces the chance of ballooning the coil tubing; 3) Optimization of the three parameter set points and thereby increasing the rate of penetration; and 4) an HMI user interface 20 that provides ease of operation for the Operator. In an embodiment, the system 10 can be utilized during other types of coiled-tubing drilling than milling.

A custom manifold 30 in FIG. 22 can be mounted to the injector frame 17 which includes hydraulic control of both the Mill-Right system 10 and existing circuitry. The design reduces the plumbing required to hydraulically integrate systems and allows for consistent execution throughout the injector models.

The Mill-Right system 10 components include:

1—Closed loop electro-proportional valve 35 seen in FIGS. 1 and 22 (D03) to control the Injector motors 25 while milling 1—Discrete solenoid valve to enable the Mill-Right system 5—Cartridge valves for Mill-Right isolation and override control valves for integration with the existing closed loop circuit. (CB pilot isolation, Brake, and 2-Speed override)

1—Small pressure filter to filter hydraulic fluid to the Mill-Right system 10

3—Pressure feedback devices 45, such as transducers mounted remotely from manifold 30

Existing Injector hydraulic circuitry and components (unchanged from customer design) include:

2—Cartridge Counterbalance Valves 40 for hydraulic load holding on full displacement (both motors)

4—pressure/directional control valves 45 for automatic control of the injector brake (on/off) including "Brake Stand" function Porting for direct (flange) mount of customer specified pressure filters Porting 55 for supply of hydraulic fluid to the (2) drive motors 25 (i.e. no external tee manifolds) with the option for installation of hard piping Note: In the event of component failure all integrated control valves are designed to fail to the injectors' normal operating condition.

Requirements for Mill-Right system 10 external to proposed manifold 30:

Bulkhead provisions for P. comp pressure supply and low pressure return for Mill-Right control manifold 30 (Approx. 3000 PSI @ 5 GPM)

Pressure filter 50 for P. Comp supply to protect against contamination

1—Small accumulator (1 gallon or less) and related plumbing remote mounted from manifold Wiring harness from HMI (console) to injector junction box Wiring from injector junction box to devices (Note: must be zone II, not zone I). FIG. 22.

In an embodiment, the mill-right system 10 can be integrated with the injector 15 in a different manner than disclosed herein. In an embodiment, the human-machine interface 20 may display and function differently than disclosed herein. In an embodiment, the mill-right system 10 may be modified to function with other types of drilling.

1.0 Introduction

The Mill-Right system 10 is a complete hydraulic control system that optimizes milling performance by accurately controlling the speed and force at the Milling bit.

The following three conditions are monitored;

1. Weight on Bit (WOB)
2. Rate of Penetration (ROP)
3. Differential Circulation Pressure (DP)

The system is comprised of 4 subsystems:

1. HMI (Human Machine Interface) touchscreen 10—The Operator's Interface with the system
2. The Hydraulic System 12
3. The Electrical System 60 in FIGS. 18 and 19
4. The software control routine (program within the HMI and Motion Control PLC)

Operationally, values for each of the 3 milling modes (WOB, ROP, and DP) are selected as set points by the operator and input into the control system via the HMI 20 as seen in in Boxes 1 and 2 of FIG. 2A and FIGS. 3, 4, and 6. The HMI inputs are then translated by the Motion Controller 65 (FIGS. 1 and 18) to command a hydraulic high response proportional valve that in turn controls oil flowing to the injector motors 25 whereby increasing and decreasing the down speed, i.e., in the direction of the bottom of the hole, of the tubing string during the milling process. The Motion Controller 65 compares feedback instrumentation measuring speed, force, and circulation system pressure with the operator set points and adjusts the valve commands to close the loop and control the system 10 accurately.

2.0 Basic Block Diagram of Mill-Right Controls

The Mill-Right system 10 accurately controls the Injector Motors 25, so that the weight on bit (WOB), rate of penetration (ROP), and differential circulation pressure (DP) may be precisely controlled. The operator inputs the desired setpoints into the HMI screen 20 and then the setpoints are processed by the Motion Controller 65. The milling parameters used (WOB, ROP, and DP) will reflect how the proportional valve 35 will control the injector motors 25. The motion controller 65 receives feedback from a load cell 70, a circulation pressure transducer 45, and an injector encoder 75 as illustrated in FIG. 1. The motion controller 65 reads the feedback from these devices every few milliseconds, compares them to the target setpoints set by the HMI 20, and automatically adjusts the output to the proportional valve 35 to provide the necessary control of the injector motors 25. FIG. 1.

3.0 General Description of Operation

Figure 2A:
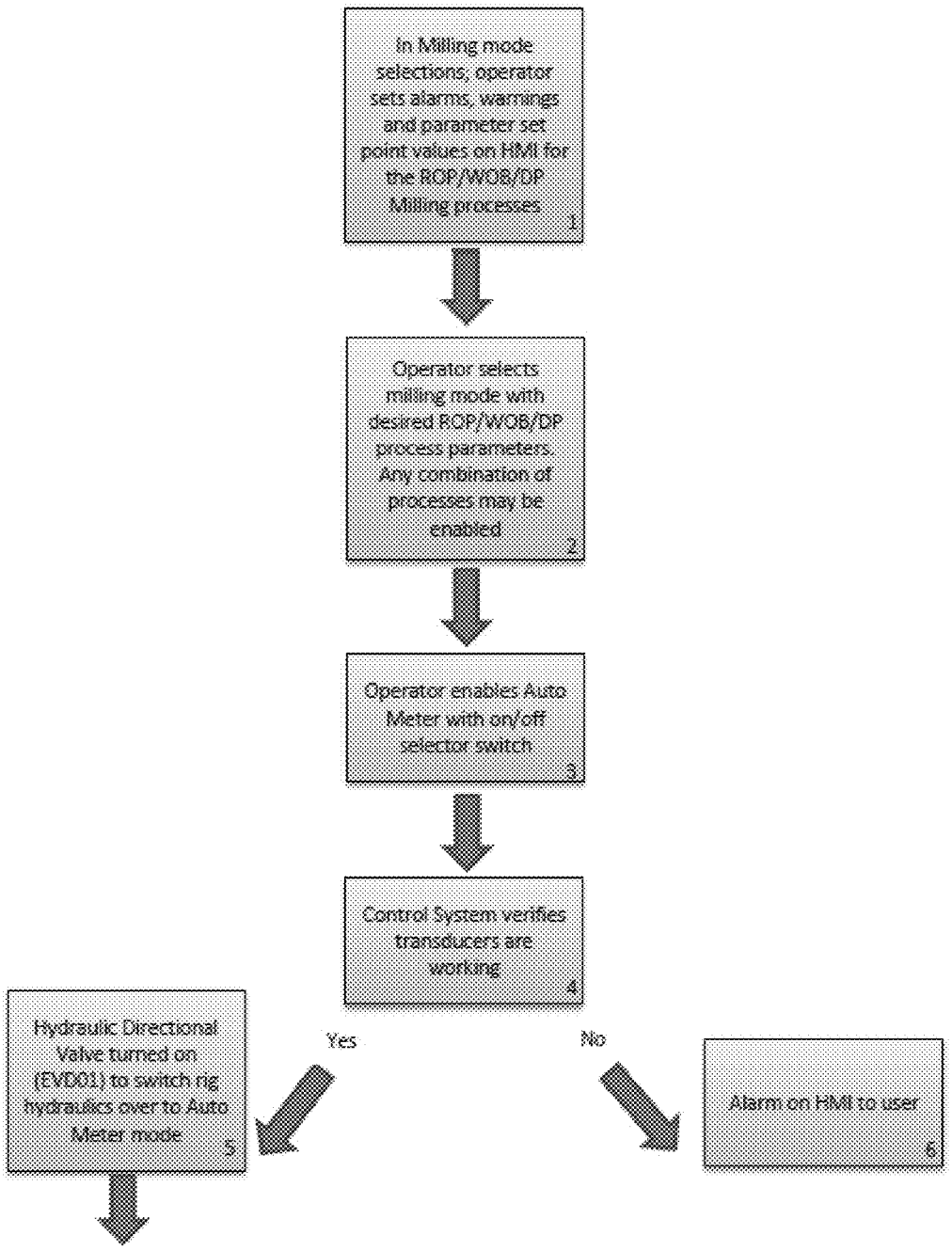
FIG. 2 depicts a flow chart of the in-depth process of the mill-right system.

The operator selects a milling mode with desired milling parameters enabled as well as setpoints, warning values, and alarming/shutdown values, boxes 1 and 2 in FIG. 2A. When the operator starts the system, box 7 in FIG. 2B, the automatic milling control constantly monitors and adjusts for weight on bit (WOB), rate of penetration (ROP), and circulation differential pressure (DP) based on which parameters are enabled, boxes 13 and 13*a* in FIG. 2C. The system will stop the milling sequence once the depth limit has been reached, boxes 13*a* and 15 in FIG. 2C, or the operator has interrupted the routine through the HMI, E-stop, Reel Brake or external injector commands i.e. In/Out Injector joystick, box 13*b* in FIG. 2C.

To start the Mill-Right system 10 the operator will:

1. Pick up the milling tool up off bottom, boxes 8 and 9 in FIG. 2B; Turn on circulation pump.
2. Select desired milling mode, box 2 in FIG. 2A, on the HMI screen 20.
3. Turn the on/off switch to the On position on the HMI panel & wait until the "Mill-Right Enabled" displays on the HMI screen, box 3 in FIG. 2A.
4. Push the start button on the HMI panel, box 7 in FIG. 2B.
5. Confirm that the Milling Tool is off bottom via a push button on the HMI screen when prompted, box 8 and 9 in FIG. 2B.
6. Either enters the injector depth manually as set or takes the current injector depth seen on the HMI screen, box 11 in FIG. 2B and FIG. 14.
7. Select one of the directions using the button (Vertical/Horizon) for milling operation and then push OK, box 11 in FIG. 2B and FIG. 14.
8. Mill-Right system 10 will begin operation, box 13 in FIG. 2C.

NOTE: It is not recommended to set the Mill-Right system 10 based on one milling method. It is advised to set Mill-Right system 10 with at least two parameters (WOB, ROP, DP) to optimize the process.

Figure 2B:
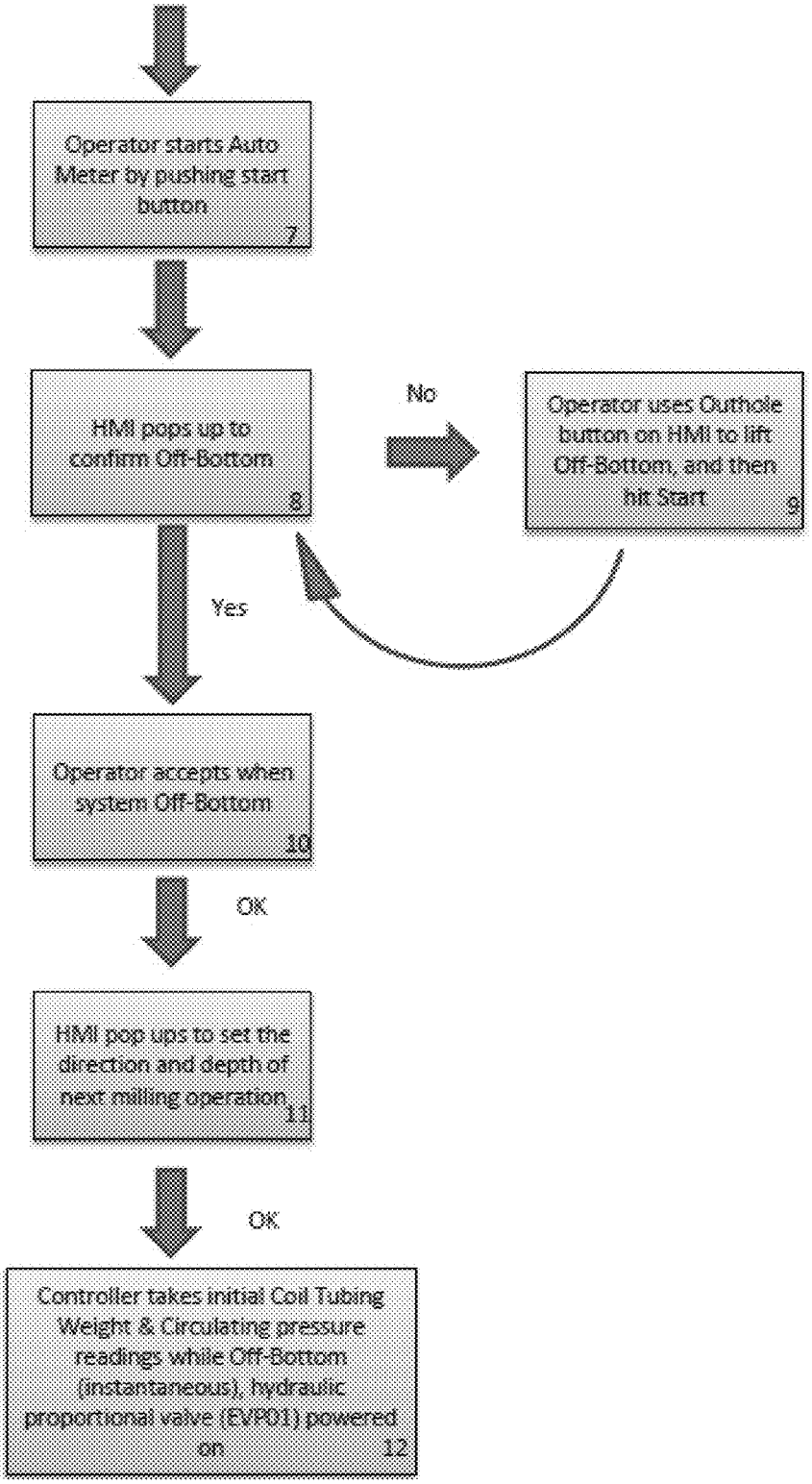
Figure 2C:
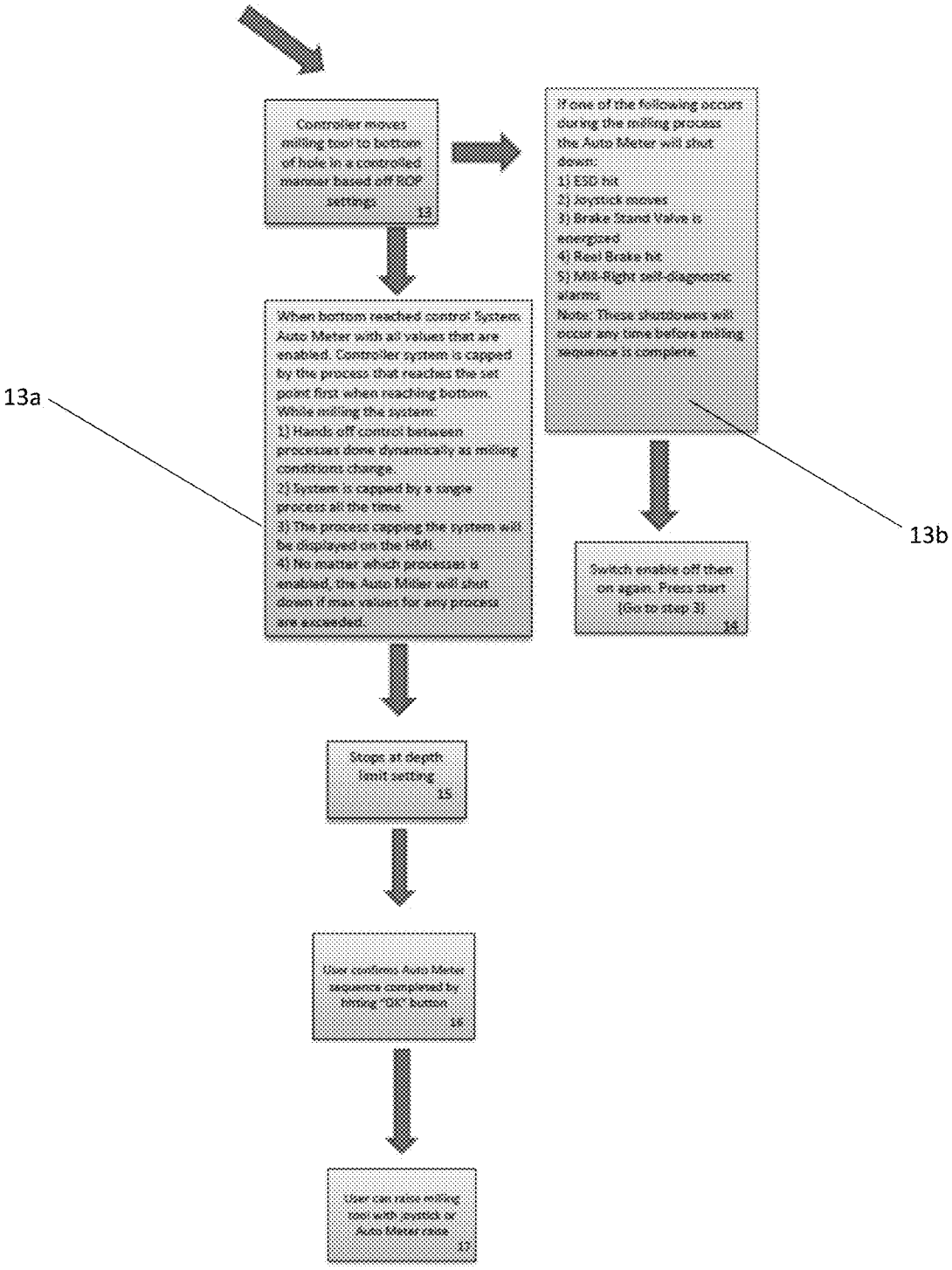

The Mill-Right flow chart in FIGS. 2A, 2B, and 2C provides an in-depth process of the system. The prefatory number refers to the box number in the flow chart illustrated in FIGS. 2A, 2B, and 2C.

1: In Milling mode selections; operator sets alarms, warnings and parameter set point values on HMI for the ROP/WOB/DP Milling processes.

2: Operator selects milling mode with desired ROP/WOB/DP process parameters. Any combination of processes may be enabled.

3: Operator enables Auto Meter with on/off selector switch.

4: The Control System verifies that the transducers are working.

5: If yes: Hydraulic Directional Valve turned on (EVD01) to switch rig hydraulics over to Auto Meter mode.

6: If no: Alarm on HMI alerts user.

7: Following switching the rig hydraulics to Auto Meter Mode, the Operator starts Auto Meter by pushing start button.

8: HMI pops up to confirm Off-Bottom.

9: If no, the Operator uses Outhole button on HMI to lift Off-Bottom, and then hit Start and return to 8.

10: If Yes, the Operator accepts when system Off-Bottom.

11: HMI pop ups to set the direction and depth of next milling operation.

12: Controller takes initial Coil Tubing Weight & Circulating pressure readings while Off-Bottom (instantaneous), hydraulic proportional valve (EVP01) powered on.

13: Controller moves milling tool to bottom of hole in a controlled manner based off ROP settings. When bottom reached control System Auto Meter with all values that are enabled. Controller system is capped by the process that reaches the set point first when reaching bottom. While milling the system: 1) Hands off control between processes done dynamically as milling conditions change. 2) System is capped by a single process all the time. 3) The process capping the system will be displayed on the HMI. 4) No matter which processes is enabled, the Auto Miller will shut down if max values for any process are exceeded.

If one of the following occurs during the milling process the Auto Meter will shut down: 1) ESD hit 2) Joystick moves 3) Brake Stand Valve is energized 4) Reel Brake hit and 5) Mill-Right self-diagnostic alarms. Note: These shutdowns will occur any time before milling sequence is complete.

14: Switch enable off then on again. Press start (Go to step 3).

15: Following reaching the bottom, the milling tool stops at depth limit setting.

16: User confirms Auto Meter sequence completed by pressing the "OK" button.

17: The user can raise milling tool with the joystick or the Auto Meter can raise the milling tool.

4.0 Operators Interface 4.1 Object Types

1. Numerical Input Box

A numerical input box is a dual purpose box. It will display the current value of the parameter it is displaying and can be used to enter a new value. To enter a value press on the box and a numerical keypad will pop up. Enter the desired value into the keypad and press the "ENT" button on the keypad to enter the value and close the keypad. On the keypad the "ES" button will close the keypad without changing the numerical value and the "CS" button will clear the entry field.

2. Numerical Display Box

A numerical display box is used to display a numeric value as current.

3. Text Input Box

A text input box is a dual purpose box. It will display the current text value associated with the box and can be used to enter a new text value. To enter a text value press on the box and a keyboard will pop up. Enter the desired text value into the keypad and press the "Enter" button on the keypad to enter the value and close the keyboard.

4. Text Box

A text box is used to display the text associated with the box.

5. Standard Button

A standard button will perform the task associated with the button when the button is pressed.

6. Status Button

A status button is a dual purpose button. The color and/or text on the button will change based on the status of the variable associated with the button. The button will also perform the task associated with the button when the button is pressed.

7. Trend Display

[0100] A trend display is used for displaying the setpoint and current value of one of three Milling parameters as well as to increment the setpoint up and down.

The value displayed at the top left of the trend display is the milling parameter's Max Value as defined in the Milling Mode.

The value displayed at the bottom left of the trend display is the milling parameter's Min Value as defined in the Milling Mode.

The trend display will display the current milling parameter setpoint with green and the milling parameter actual value with blue based on the scale to the left of the graph created between the Min and Max values.

The actual value in the numerical display box will be green while the actual value of the parameter is below the warning value, yellow when it is above the warning value and red when above the alarming value.

The "+" and "−" button can used to increment and decrement the milling parameter's setpoint respectively.

The value of the increment/decrement associated with the "+" and "−" buttons are defined by the following equation:

$$\text{Increment or Decrement Value} = \text{Max Value} - \text{Min Value}/100$$

Figure 3:
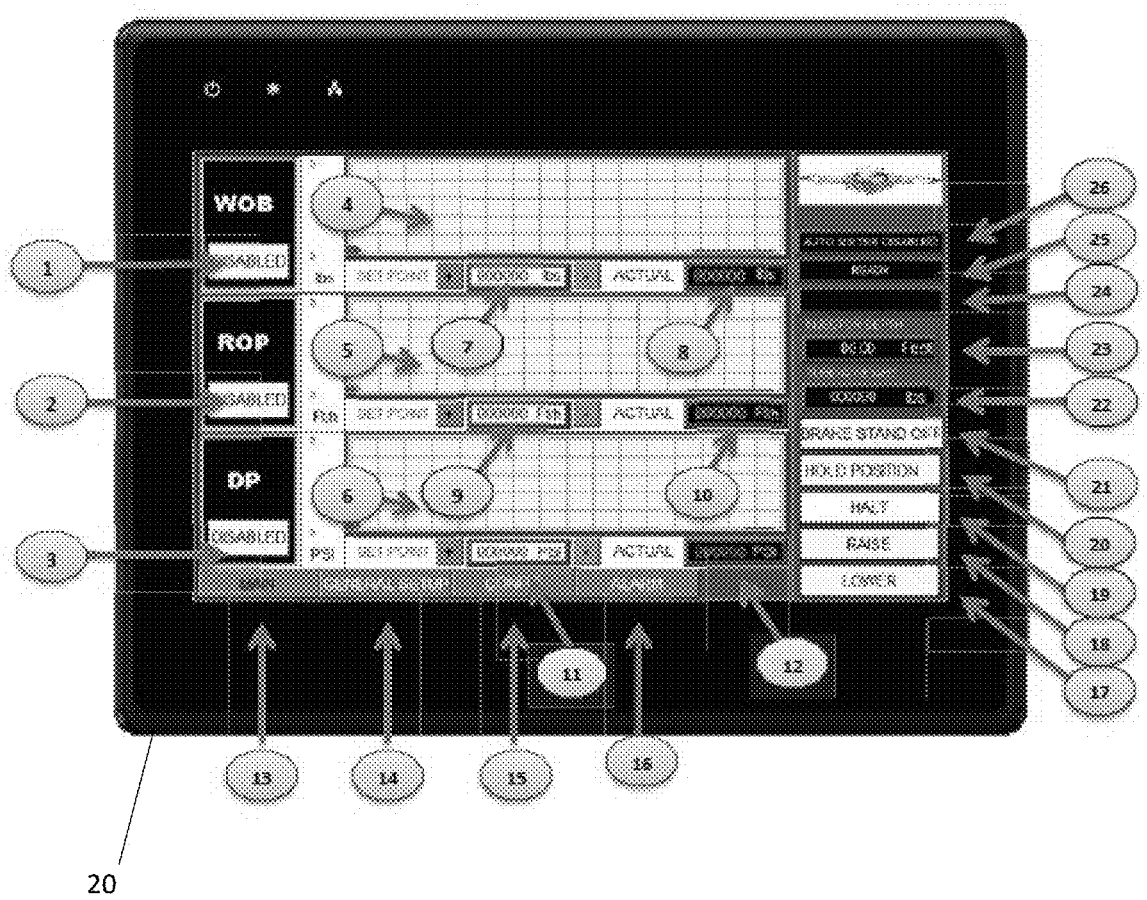
FIG. 3 depicts the main screen of the mill-right system.
Figure 4:
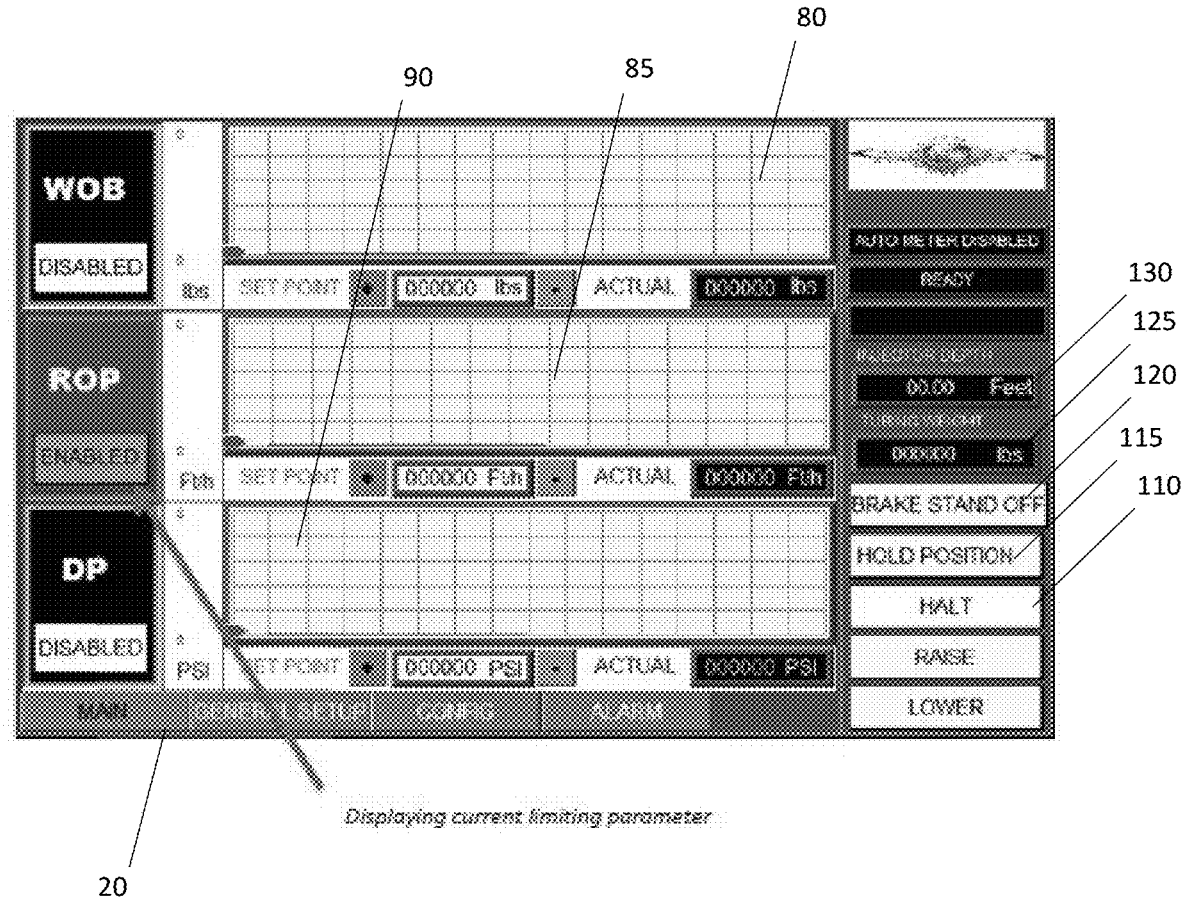
FIG. 4 depicts a screen for ROP limiting.

4.2 Main Screen. FIGS. 3 and 4.

1. WOB Status Button

The WOB Status button displays the current status of the WOB control and allows for Enabling and Disabling the WOB control.

If WOB control is Enabled the button will be green and will have "Enabled" displayed on the button.

If WOB control is Disabled the button will be white and will have "Disabled" displayed on the button.

To change the WOB control from its current state, press the WOB Status button and then click the OK button on the pop-up to confirm the operation.

2. ROP Status Button

The ROP Status button displays the current status of the ROP control and allows for Enabling and Disabling of the ROP control.

If ROP control is Enabled the button will be green and will have "Enabled" displayed on the button.

If ROP control is Disabled the button will be white and will have "Disabled" displayed on the button.

To change the ROP control from its current state, press the ROP Status button and then click the OK button on the pop-up to confirm the operation.

3. DP Status Button

The DP Status button displays the current status of the DP control and allows for Enabling and Disabling the DP control.

If DP control is Enabled the button will be green and will have "Enabled" displayed on the button.

If DP control is Disabled the button will be white and will have "Disabled" displayed on the button.

To change the DP control from its current state, press the DP Status button and then click the OK button on the pop-up to confirm the operation.

4. WOB Trend Display 80 in FIG. 4

The WOB graph is used for displaying the current setpoint and current actual value of WOB as well as to increment to setpoint up and down.

5. ROP Trend Display 85 in FIG. 4

The ROP graph is used for displaying the current setpoint and current actual value of ROP as well as to increment to setpoint up and down.

6. DP Trend Display 90 in FIG. 4

The DP graph is used for displaying the current setpoint and current actual value of DP as well as to increment to setpoint up and down.

7. WOB Setpoint Numerical Input Box

The WOB setpoint numerical input box displays the current Setpoint for the WOB parameter as well as it can be used to enter a new WOB Setpoint.

Notes: The Min and Max restrictions on the setpoint value are based on the Min and Max values as defined in the Milling Mode selection.

Any setpoint changes made from this numerical box or "+" and "−" buttons are not saved to the Milling Mode selection but are kept as current until another milling mode is selected or the current milling mode is reloaded.

Figure 5:
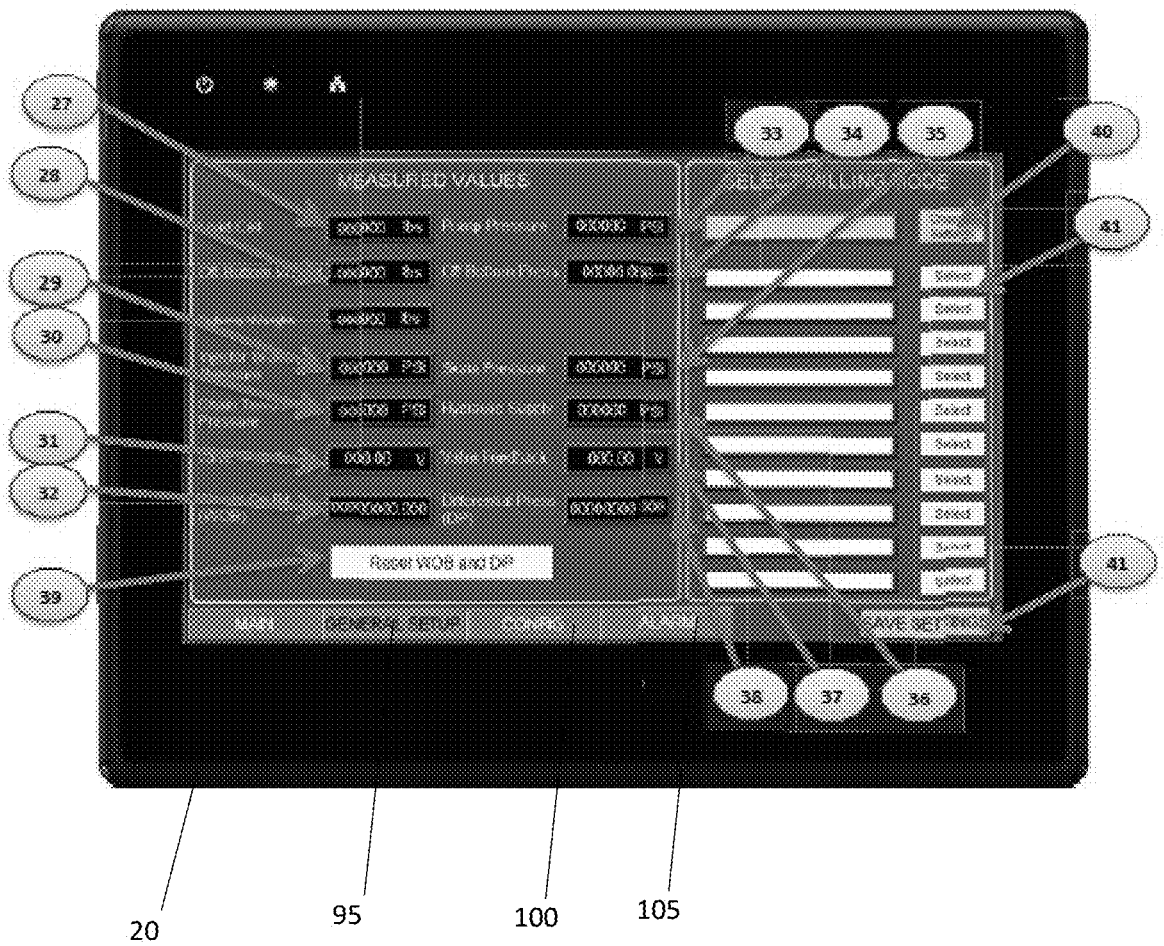
FIG. 5 depicts the general setup screen of the mill-right system.

8. WOB Actual Numerical Display Box (FIG. 5)

The WOB actual numerical display box displays and allows for the changing of the current actual WOB as seen by the system. Note: The WOB displayed will only be accurate during Mill-Right operation.

9. ROP Setpoint Numerical Input Box

The ROP setpoint numerical input box displays the current Setpoint for the ROP parameter as well as it can be used to enter a new ROP Setpoint.

Notes: The Min and Max restrictions on the setpoint value are based on the Min and Max values as defined in the Milling Mode selection. Any setpoint changes made from this numerical box or "+" and "−" buttons are not saved to the Milling Mode selection but are kept as current until another milling mode is selected or the current milling mode is reloaded.

10. ROP Actual Numerical Display Box

The ROP actual numerical display box displays the current actual ROP. Note: The ROP displayed will always be accurate regardless if the Mill-Right is in operation or not.

11. DP Setpoint Numerical Input Box

The DP setpoint numerical input box displays the current Setpoint for the DP parameter as well as it can be used to enter a new DP Setpoint.

Notes: The Min and Max restrictions on the setpoint value are based on the Min and Max values as defined in the Milling Mode selection. Any setpoint changes made from this numerical box or "+" and "−" buttons are not saved to the Milling Mode selection but are kept as current until another milling mode is selected or the current milling mode is reloaded.

12. DP Actual Numerical Display Box

The DP actual numerical display box displays the current actual DP as seen by the system. Note: The DP displayed will only be accurate during Mill-Right operation.

13. Main Button (no. 48 in FIG. 6)

The Main button is used to go to the Main page when on a different page on the HMI. If the button is green the displayed page will be the Main page and pushing the button will have no effect.

14. General Setup Button 95 in FIG. 5.

The General Setup button is used to go to the General Setup page when on a different page on the HMI. If the button is green the displayed page will be the General Setup page and pushing the button will have no effect.

15. Config Button 100 in FIG. 5.

The Config button is used to go to the Configuration page when on a different page on the HMI. If the button is green, the displayed page will be the Configuration page and pushing the button will have no effect.

16. Alarm Button 105 in FIG. 5

The Alarm button is used to go to the Alarm page when on a different page on the HMI. If the button is green, the displayed page will be the Alarm page and pushing the button will have no effect.

17. Inhole Button

The Lower button can be used to lower the injector while the Mill-Right is enabled. While pressed the injector will lower at a speed determined by Lowering Output setting defined on the Configuration—General Screen of the HMI 18. Outhole Button The Raise button can be used to raise the injector while the Mill-Right is enabled. While pressed the injector will raise at a speed determined by Raising Output setting defined on the Configuration-General screen of the HMI.

19. Halt Button 110 in FIG. 4.

The Halt button can be used to disable the Mill-Right system at any point while it is enabled. Once pressed the button will read "Halted" to let the user know the system has been halted. If the system is disabled using the Halt button the Mill-Right must be turned Off and then On to reset the Mill-Right.

20. The Hold Position Button 115 in FIG. 4.

The Hold Position button can be used to stop a milling sequence without disabling the Mill-Right system. Once pressed the Hold Position pop-up will occur.

21. Brake Stand Button 120 in FIG. 4.

The Brake Stand button can be used to apply the brake stand valve and disable the Mill-Right system at any point while it is enabled. Once pressed there will be a pop-up to confirm the operation. If brake stand on is confirmed "Brake Stand On" message will be shown to let the user know the brake stand has been applied. If the system is disabled using the brake stand button the Mill-Right must be turned Off and then On to reset the Mill-Right.

22. Tubing Weight Numerical Display Box 125 in FIG. 4.

The Tubing Weight numerical display box is used to display the current tubing weight as calculated with current depth of Injector and coil tubing weight per distance setting defined on the Configuration—General screen of the HMI.

23. Injector Depth Numerical Display Box 130 in FIG. 4.

The Injector Depth numerical display box is used to display the current injector depth as seen by the Mill-Right system.

24. Milling Mode Selected Text Box

The Milling Mode Selected text box displays the current selected Milling Mode within the Mill-Right system. It is a display only and if a change in Milling Mode is required that must be done on the HMI General Setup screen as shown in section 4.4.

25. Mill-Right Operation Status Box

The Mill-Right Operation status box reflects the current state of the Mill-Right system. If the Mill-Right is ready to start milling the status box will be white and the text "READY" will be displayed. If the Mill-Right has started milling the status box will be green and the text "Milling" will be displayed.

26. Mill-Right Status Box

The Mill-Right status box reflects the current state of the Mill-Right system. If the Mill-Right is disabled the status box will be white and the text "Mill-Right Disabled" will be displayed. If the Mill-Right is enabled the status box will be green and the text "Mill-Right Enabled" will be displayed.

4.3 Example of ROP Limiting (FIG. 4.)

FIG. 4. Main Screen. The arrow indicates the current limiting parameter.

4.4 General Setup Screen

FIG. 5 General Setup Screen (FIG. 5)

No. 27 in FIG. 5. Load Cell Numerical Display Box

The Load Cell numerical display box is used to display the current load cell force as seen by the Mill-Right System.

No. 28 in FIG. 5. Off Bottom Weight Numerical Display Box

The Off Bottom Weight numerical display box is used to display the current off bottom weight as seen by the Mill-Right System. Once auto milling sequence has started the off bottom weight will be measured and kept as same until the next auto milling sequence starts.

No. 29 in FIG. 5. Injector Brake Pressure Numerical Display Box

The Injector Brake Pressure numerical display box is used to display the current injector brake pressure as seen by the Mill-Right System.

No. 30 in FIG. 5. Chain Tension Pressure Numerical Display Box

The Chain Tension Pressure numerical display box is used to display the current chain tension pressure as seen by the Mill-Right System.

No. 31 in FIG. 5. Valve Output Numerical Display Box

The Valve Output numerical display box is used to display the current output in Volts to the proportional valve EVP01 of the Mill-Right system.

No. 32 in FIG. 5. Weight On Bit (WOB) Numerical Display Box

The Weight On Bit (WOB) numerical display box is used to display the current Weight On Bit as calculated by Tubing weight, Off Bottom Weight, and Load Cell force seen by the Mill-Right System.

No. 33 in FIG. 5. Pump Pressure Numerical Display Box

The Pump Pressure numerical display box is used to display the current circulation pump pressure as seen by the Mill-Right System.

No. 34 in FIG. 5. Off Bottom Pressure Numerical Display Box

The Off Bottom Pressure numerical display box is used to display the current off bottom circulation pump pressure as seen by the Mill-Right System. Once auto milling sequence has started the off bottom pressure will be measured and kept updating as current until milling tool hit the bottom.

No. 35 in FIG. 5. Skate Pressure Numerical Display Box

The Skate Pressure numerical display box is used to display the current skate pressure as seen by the Mill-Right System.

No. 36 in FIG. 5. Hydraulic Supply Numerical Display Box

The Hydraulic Supply numerical display box is used to display the current supply pressure as seen by the Mill-Right System.

No. 37 in FIG. 5. Valve Feedback Numerical Display Box

The Valve Feedback numerical display box displays the current spool feedback in Volts of the proportional valve EVP01. Note if valve is operating properly and the Mill-Right system is enabled the Valve Feedback should match the Valve Output.

No. 38 in FIG. 5. Differential Pressure (DP) Numerical Display Box

The Differential Pressure (DP) numerical display box is used to display the current differential pressure as calculated by off bottom pressure and pump pressure seen by the Mill-Right System.

No. 39 in FIG. 5. Reset WOB and DP Button

The Reset WOB and DP button can be used to reset the WOB and DP calculations if the milling tool is Off Bottom. The WOB and DP values are calculated within the program based off the Off Bottom Weight and Pump pressure. When using the Mill-Right for milling, the Off Bottom Weight values are stored automatically before a Milling Sequence begins and allows for accurate WOB and DP readings during the Milling Sequence however if the milling sequence was started while On Bottom or the circulation pump was not running the stored off bottom values will be incorrect. To manually reset the Off Bottom values, use this button while off bottom and with the pump running.

No. 40 in FIG. 5. Milling Mode Change General Setup Button

The Change General Setup button is used to access the Milling Mode screen to change setpoints and parameters for the currently selected Milling Mode. The current Milling Mode is displayed above the Change General Setup button.

No. 41 in FIG. 5. Milling Mode 1-10

The Milling Mode displays the name associated with each Milling Mode and allows the selection of any one of the Milling Modes by pressing the Select button. Once the Select button is pressed the name of Milling Mode that was selected will be displayed above the Change General Setup Button. Use the Change General Setup button once the Milling Mode is selected to change the name, setpoints, and parameters of the selected Milling Mode.

No. 42 in FIG. 5. Save General Setup Button

The Save General Setup button is used to save the values associated with the Top Travel Limit, Alarm Setpoints, and Alarm Setpoint Debounce Times to the flash memory of the system. By saving the values to flash memory all values saved in the system will not be lost in the case of loss of power to the system.

Figure 6:
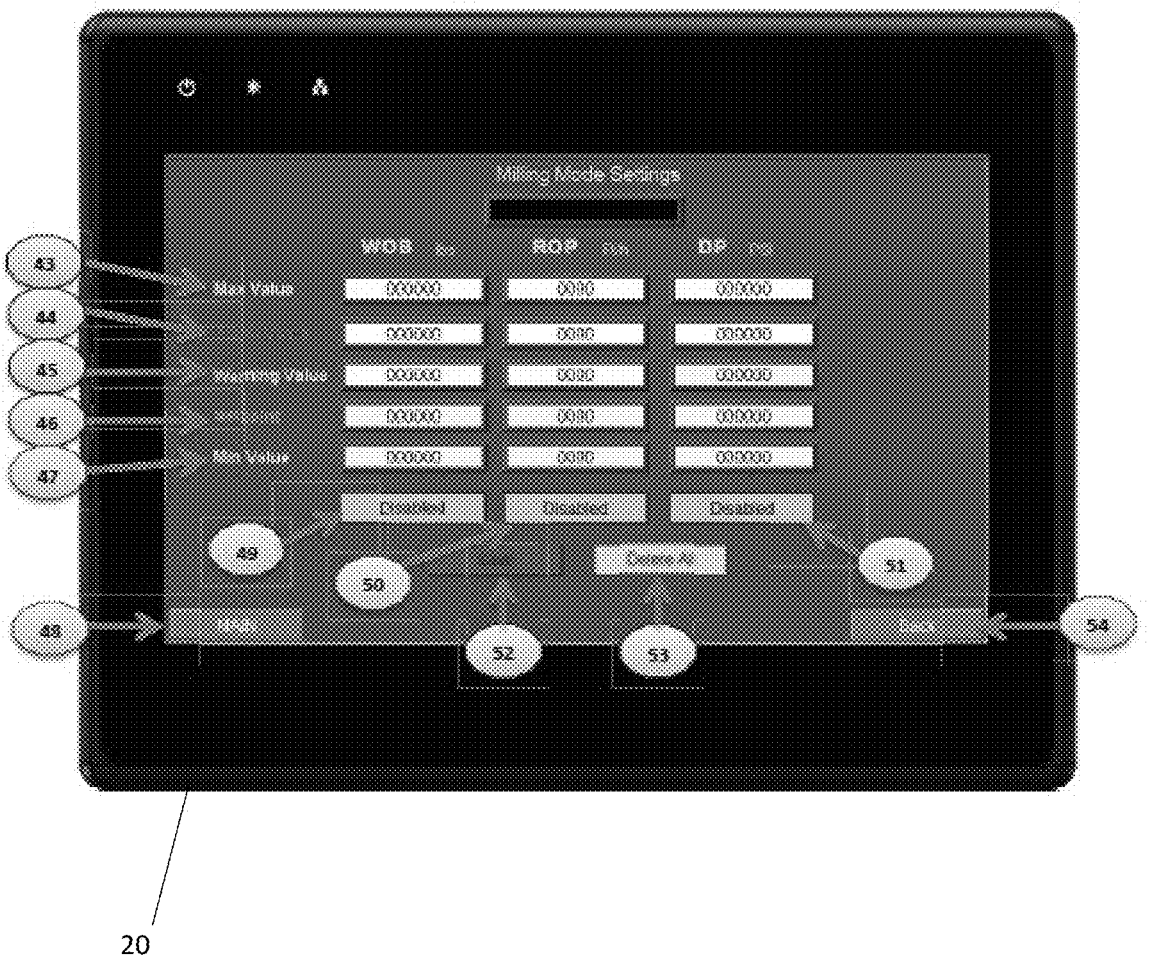
FIG. 6 depicts the milling mode screen of the mill-right system.

4.5 Milling Mode Screen (FIG. 6)

FIG. 6. Milling Mode Screen

No. 43 in FIG. 6. Max Value Numerical Input Boxes

The Max Value numerical input boxes will display the current Max Values for WOB, ROP and DP as well as they can be used to enter a new Max Value. The Max Value is also used as the upper number on the Trend Display scale on the Main page. Note the maximum input values for Max Value are as follows; WOB 90000 lbf or 40339 daN, ROP 1317 ft/h or 401 m/h, DP 800 PSI or 5515 kPa.

No. 44 in FIG. 6. Alarm Value Numerical Input Boxes

The Alarm Value numerical input boxes will display the current Alarm Values for WOB, ROP and DP as well as they can be used to enter new Alarm Values. The Alarm Value is the value that the milling parameter can reach while the Mill-Right is enabled before shutting down after the debounce time. Note the maximum input values for Alarm Value is defined by the Max Value for the associated parameter.

No. 45 in FIG. 6. Warning Value Numerical Input Boxes

The Warning Value numerical input boxes display the current Warning Values for WOB, ROP and DP as well as they can be used to enter new Warning Values. The Warning Value is the value that the milling parameter can reach while the Mill-Right is enabled before an audible tone will alert the operator that the Warning value has been reached. Note the maximum input values for Warning Value is defined by the Max Value for the associated parameter.

No. 46 in FIG. 6. Setpoint Numerical Input Boxes

The Setpoint numerical input boxes display the current Setpoints for WOB, ROP and DP as well as they can be used to enter a new Setpoint. The Setpoint is the value that Mill-Right will try to maintain during a milling sequence. Note the maximum input values for Setpoint is defined by the Max Value for the associated parameter.

No. 47 in FIG. 6. Min Value Numerical Input Boxes

The Min Value numerical input boxes display the current Min Values for WOB, ROP and DP as well as they can be used to enter new Min Values. The Min Value is used as the lower number on the Trend Display scale on the Main page.

No. 48 in FIG. 6. Milling Mode—Main Button

The Main button is used to go to the Main page directly from the Milling Mode Setting screen. Note: Be sure to Save the milling mode before leaving the Milling Mode Setting page.

No. 49 in FIG. 6. Milling Mode—WOB Status Button

The WOB Status button displays the default state of the WOB control and allows for Enabling and Disabling the WOB control. If WOB control is Enabled the button will be green and will have "Enabled" displayed on the button. If WOB control is Disabled the button will be grey and will have "Disabled" displayed on the button. To change the WOB control from its current state, press the WOB Status button and then click the OK button on the pop-up to confirm the operation. Note: That the status of the WOB control may be changed on the Main Screen once the Milling Mode is selected and that this setting will only be the default setting when the Milling Mode is first selected.

No. 50 in FIG. 6. Milling Mode—ROP Status Button

The ROP Status button displays the default state of the ROP control and allows for Enabling and Disabling the ROP control. If ROP control is Enabled the button will be green and will have "Enabled" displayed on the button. If ROP control is Disabled the button will be grey and will have "Disabled" displayed on the button. To change the ROP control from its current state, press the ROP Status button and then click the OK button on the pop-up to confirm the operation. Note: That the status of the ROP control may be changed on the Main Screen once the Milling Mode is selected and that this setting will only be the default setting when the Milling Mode is first selected.

No. 51 in FIG. 6. Milling Mode—DP Status Button

The DP Status button displays the default status of the DP control and allows for Enabling and Disabling the DP control. If DP control is Enabled the button will be green and will have "Enabled" displayed on the button. If DP control is Disabled the button will be grey and will have "Disabled" displayed on the button. To change the DP control from its current state, press the DP Status button and then click the OK button on the pop-up to confirm the operation. Note: That the status of the DP control may be changed on the Main Screen once the Milling Mode is selected and that this setting will only be the default setting when the Milling Mode is first selected.

No. 52 in FIG. 6. Save Button

The Save button is used to save the values associated with the Milling Modes to the flash memory of the system. By saving the values to flash memory all values saved in the system will not be lost in the case of loss of power to the system.

No. 53 in FIG. 6. Delete All Button

The Delete All button is used to clear all fields on the Milling Mode General Setup screen. Note: After using this button if the milling mode is not saved when the mode is reloaded it will have the values saved before the button was pressed.

No. 54 in FIG. 6. Milling Mode—Back Button

The Back button is used to go to back to the General Setup Screen from the Milling Mode General Setup screen. Note: Be sure to Save the milling mode before leaving the Milling Mode General Setup page 4.6 Configuration—General Screen (FIG. 7)

Figure 7:
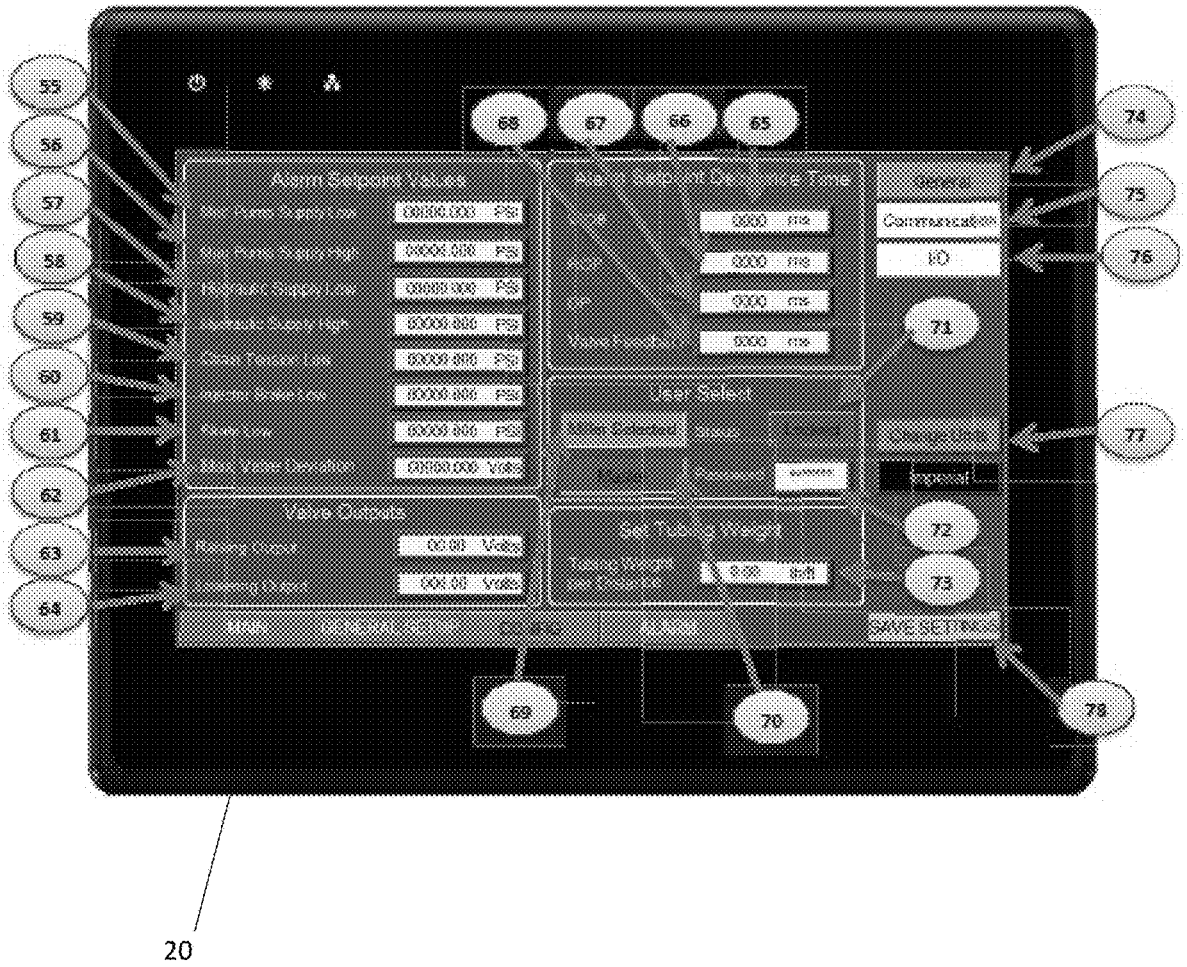
FIG. 7 depicts the general screen of the mill-right system.

FIG. 7 Configuration—General Screen.

No. 55 in FIG. 7. Circulation Supply Low Numerical Input Box

The Circulation Pump Supply Low numerical input box will display the current Circulation Pump Supply Low value as well as it can be used to enter a new Circulation Pump Supply Low value. The Circulation Pump Supply Low is used for alarming and disabling the Mill-Right system. If the actual Circulation Pump pressure drops below Circulation Pump Supply Low value while the Mill-Right is enabled then an alarm will sound and the Mill-Right will shut down.

No. 56 in FIG. 7. Circulation Supply High Numerical Input Box

The Circulation Pump Supply High numerical input box will display the current Circulation Pump Supply High value as well as it can be used to enter a new Circulation Pump Supply High value. The Circulation Pump Supply High is used for alarming and disabling the Mill-Right system. If the actual Circulation Pump pressure goes above the Circulation Pump Supply High value while the Mill-Right is enabled then an alarm will sound and the Mill-Right will shut down.

No. 57 in FIG. 7. Hydraulic Supply Low Numerical Input Box

The Hydraulic Supply Low numerical input box will display the current Hydraulic Supply Low value as well as it can be used to enter a new Hydraulic Supply Low value. The Hydraulic Supply Low is used for alarming and disabling the Mill-Right system. If the actual Hydraulic pressure drops below the Hydraulic Supply Low value while the Mill-Right is enabled then an alarm will sound and the Mill-Right will shut down.

No. 58 in FIG. 7. Hydraulic Supply High Numerical Input Box

The Hydraulic Supply High numerical input box will display the current Hydraulic Supply High value as well as it can be used to enter a new Hydraulic Supply High value. The Hydraulic Supply High is used for alarming and disabling the Mill-Right system. If the actual Hydraulic pressure goes above the Hydraulic Supply High value while the Mill-Right is enabled then an alarm will sound and the Mill-Right will shut down.

No. 59 in FIG. 7. Chain Tension Low Numerical Input Box

The Chain Tension Low numerical input box will display the current Chain Tension Low value as well as it can be used to enter a new Chain Tension Low value. The Chain Tension Low is used for alarming and disabling the Mill-Right system. If the actual chain tension pressure drops below the Chain Tension Low value while the Mill-Right is enabled then an alarm will sound and the Mill-Right will shut down.

No. 60 in FIG. 7. Injector Brake Low Numerical Input Box

The Injector Brake Low numerical input box will display the current Injector Brake Low value as well as it can be used to enter a new Injector Brake Low value. The Injector Brake Low is used for alarming and disabling the Mill-Right system. If the actual injector brake pressure drops below the Injector Brake Low value while the Mill-Right is enabled, then an alarm will sound and the Mill-Right will shut down.

No. 61 in FIG. 7. Skate Low Numerical Input Box

The Skate Low numerical input box will display the current Skate Low value as well as it can be used to enter a new Skate Low value. The Skate Low is used for alarming and disabling the Mill-Right system. If the actual skate pressure drops below the Skate Low value while the Mill-Right is enabled then an alarm will sound and the Mill-Right will shut down.

No. 62 in FIG. 7. Max Valve Deviation Numerical Input Box

The Max Valve Deviation numerical input box will display the current Max Valve Deviation value as well as it can be used to enter a new Max Valve Deviation value. The Max Valve Deviation is used for alarming and disabling the Mill-Right system. If the actual Valve feedback is off from the output to the valve by a greater voltage then the Max Valve Deviation value for longer than the debounce time while the Mill-Right is enabled then an alarm will sound and the Mill-Right will shut down.

No. 63 in FIG. 7. Outhole Output Numerical Input Box

The Raising Output numerical input box will display the current Raising Output value in Volts as well as it can be used to enter a new Raising Output. The Raising Output is the voltage output that will be sent to the proportional valve while pressing the Raise button. The range for the Raising Output is from 0-10V. It is recommended to have the Raising Output at 7.5V.

No. 64 in FIG. 7. Inhole Output Numerical Input Box

The Lowering Output numerical input box will display the current Lowering Output value in Volts as well as it can be used to enter a new Lowering Output. The Lowering Output is the voltage output that will be sent to the proportional valve while pressing the Lower button. The range for the Lowering Output is from −10-0V. It is recommended to have the Raising Output at −7.5V.

No. 65 in FIG. 7. WOB—Alarm Setpoint Debounce Time Numerical Input Box

The WOB—Alarm Setpoint Debounce Time numerical input will display the current WOB Alarm Debounce Time value as well as it can be used to enter a new WOB Debounce Time. The WOB—Alarm Setpoint Debounce Time is used for delaying the WOB alarm. If the actual WOB goes above the WOB Alarm value for longer than the debounce time while the Mill-Right is enabled then an alarm will sound and the Mill-Right will shut down. Note that the debounce time is in milliseconds (ms) so if a full second debounce is desired then the setting would be 1000 ms.

No. 66 in FIG. 7. ROP—Alarm Setpoint Debounce Time Numerical Input Box

The ROP—Alarm Setpoint Debounce Time numerical input box will display the current ROP Alarm Debounce Time value as well as it can be used to enter a new ROP Debounce Time. The ROP—Alarm Setpoint Debounce Time is used for delaying the ROP alarm. If the actual ROP goes above the ROP Alarm value for longer than the debounce time while the Mill-Right is enabled then an alarm will sound and the Mill-Right will shut down. Note that the debounce time is in milliseconds (ms) so if a full second debounce is desired then the setting would be 1000 ms.

No. 67 in FIG. 7. DP—Alarm Setpoint Debounce Time Numerical Input Box

The DP—Alarm Setpoint Debounce Time numerical input box will display the current DP Alarm Debounce Time value as well as it can be used to enter a new DP Debounce Time. The DP—Alarm Setpoint Debounce Time is used for delaying the DP alarm. If the actual DP goes above the DP Alarm value for longer than the debounce time while the Mill-Right is enabled then an alarm will sound and the Mill-Right will shut down. Note that the debounce time is in milliseconds (ms) so if a full second debounce is desired then the setting would be 1000 ms.

No. 68 in FIG. 7. Valve Feedback—Alarm Setpoint Debounce Time Numerical Input Box The Valve Feedback—Alarm Setpoint Debounce Time is used for delaying the Valve Feedback Mismatch alarm. If the actual Valve Feedback goes above the Valve Feedback Alarm value for longer than the debounce time while the Mill-Right is enabled then an alarm will sound and the Mill-Right will shut down. Note that the debounce time is in milliseconds (ms) so if a full second debounce is desired then the setting would be 1000 ms.

No. 69 in FIG. 7. User Select—Miller Button

The User Select—Miller button displays the current user for password purposes. If the Miller is selected the button will be green and will have "Miller Selected" displayed on the button. If the Miller is not selected the button will be red and will have "Miller" displayed on the button. To select the Miller as the user press the User Select—Miller button when it is red. If the button is green the Miller is already selected.

No. 70 in FIG. 7. User Select—Master Button

The User Select—Master button displays the current user for password purposes. If the Master is selected the button will be green and will have "Master Selected" displayed on the button. If the Master is not selected the button will be red and will have "Master" displayed on the button. To select the Master as the user press the User Select—Master button when it is red. If the button is green the Master is already selected.

No. 71 in FIG. 7. User Select—Status Button

The User Select Status Button is used to inform the user if the HMI configurations are locked or unlocked. If the configuration is locked then the Configuration Status Button will be red with the word "Locked" displayed. If the configuration is unlocked the Configuration Status Button will be green with the word "Lock" displayed. If the configuration is unlocked (green button) then the Configuration button can be pushed to lock the HMI configuration.

No. 72 in FIG. 7. User Password Numerical Input Box

The User Password numerical Input Box is used to enter the selected user password. If the password matches the selected user's password the system configuration will unlock. Note: Check the Configuration Status button to verify if password was accepted.

No. 73 in FIG. 7. Tubing Weight per Distance Numerical Input Boxes

The Tubing Weight per distance numerical input boxes display the current Tubing Weight per distance values as well as they can be used to enter new Tubing Weight per distance Values. The Tubing Weight per distance Value is used to calculate the current coil tubing weight.

Note: It is only allowed to enter new value for Tubing Weight per distance when Auto milling sequence is not running.

No. 74 in FIG. 7. Configuration—General Button

The General button is used to go to the Configuration General page when on a different configuration page on the HMI. If the button is green the displayed page will be the Configuration General page and pushing the button will have no effect. Note: The Configuration General page is the default Configuration page when the Configuration Button is pressed.

No. 75 in FIG. 7. Configuration—Communication Button

The Communication button is used to go to the Configuration Communication page when on a different configuration page on the HMI. If the button is blue the displayed page will be the Configuration Communication page and pushing the button will have no effect.

No. 76 in FIG. 7. Configuration—I/O Button

The I/O button is used to go to the Configuration I/O page when on a different configuration page on the HMI. If the button is blue the displayed page will be the Configuration I/O page and pushing the button will have no effect.

No. 77 in FIG. 7. Change Units Button

The Change Units button is used to change the HMI units from Metric to Imperial or vice versa. The current unit type is display directly below the text display box and when the button is pressed the units will switch. Note: to switch units the configuration must be unlocked.

No. 78 in FIG. 7. Save Setting Button

The Save Setting button is used to save the values associated with the Alarm Setpoint, Value outputs, Tubing weight per distance and Alarms Setpoint Debounce Times to the flash memory of the system. By saving the values to flash memory all values saved in the system will not be lost in the case of loss of power to the system.

Figure 8:
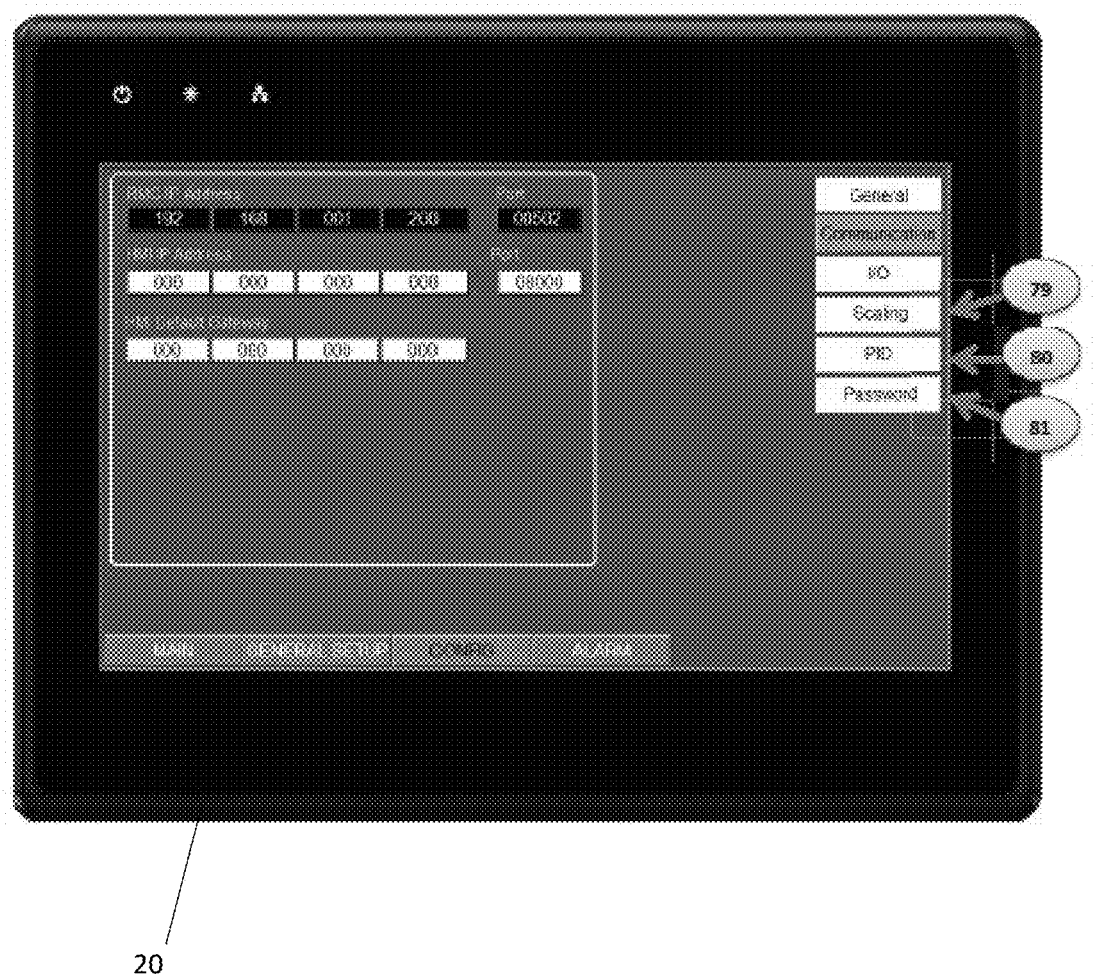
FIG. 8 depicts the communication screen of the mill-right system.

4.7 Configuration—Communication Screen (FIG. 8)

FIG. 8 Configuration—Communication Screen.

No. 79 in FIG. 8. Configuration—Scaling Button

The Scaling button is used to go to the Configuration Scaling page when on a different configuration page on the HMI. If the button is green the displayed page will be the Configuration Scaling page and pushing the button will have no effect. Note: The Configuration Scaling page is a restricted page that is only accessible to the Master user when the configuration is unlocked.

No. 80 in FIG. 8. Configuration—PID Button

The PID button is used to go to the Configuration PID page when on a different configuration page on the HMI. If the button is green the displayed page will be the Configuration PID page and pushing the button will have no effect. Note: The Configuration PID page is a restricted page that is only accessible to the Master user when the configuration is unlocked.

No. 81 in FIG. 8. Configuration—Password Button

The Password button is used to go to the Configuration Password page when on a different configuration page on the HMI. If the button is green the displayed page will be the Configuration Password page and pushing the button will have no effect. Note: The Configuration Password page is a restricted page that is accessible to the Miller or Master user when the configuration is unlocked.

Figure 9:
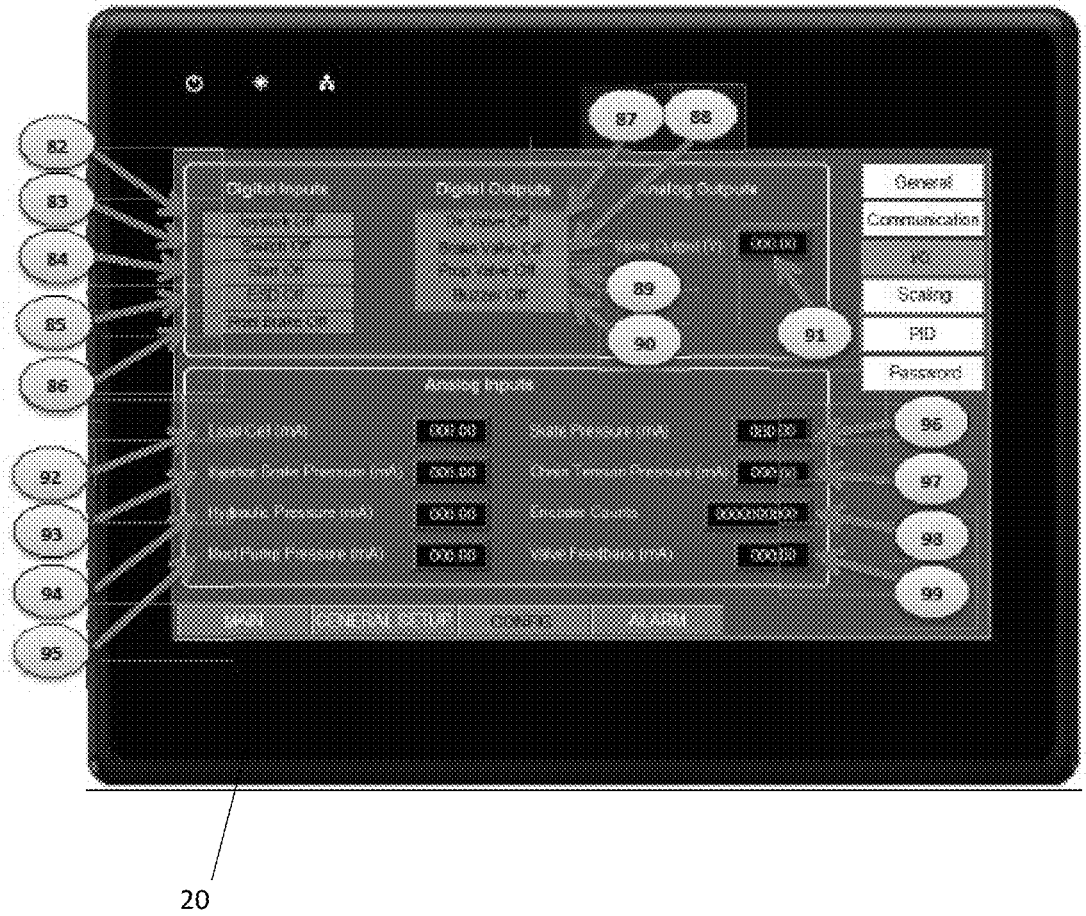
FIG. 9 depicts the input/output screen of the mill-right system.

4.8 I/O Screen (FIG. 9)

FIG. 9 I/O Screen. Note: The I/O screen is used for troubleshooting and suspected electrical problems.

No. 82 in FIG. 9. Digital Input—Joystick Status

The Digital Input—Joystick status gives the state of digital input 2 which is the Joystick input. The status will be green with the words "Joystick On" when the input is High or it will be grey with the words "Joystick Off" when the input is Low.

No. 83 in FIG. 9. Digital Input—Switch Status

The Digital Input—Switch status gives the state of digital input 0 which is the Switch On/Off input. The status will be green with the words "Switch On" when the input is High or it will be grey with the words "Switch Off" when the input is Low.

No. 84 in FIG. 9. Digital Input—Start Status

The Digital Input—Start status gives the state of digital input 1 which is the Start button input. The status will be green with the words "Start On" when the input is High or it will be grey with the words "Start Off" when the input is Low.

No. 85 in FIG. 9. Digital Input—ESD Status

The Digital Input—ESD status gives the state of digital input 3 which is the ESD input. The status will be green with the words "ESD On" when the input is High or it will be grey with the words "ESD Off" when the input is Low.

No. 86 in FIG. 9. Digital Input—Reel Brake Status

The Digital Input—Reel Brake status gives the state of digital input 4 which is the Reel Brake input. The status will be green with the words "Reel Brake On" when the input is High or it will be grey with the words "Reel Brake Off" when the input is Low.

No. 87 in FIG. 9. Digital Output—Dir Valve Status

The Digital Output—Dir Valve status gives the state of digital output 0 which is connected to the Directional Valve. The status will be green with the words "Dir Valve On" when the output is High or it will be grey with the words "Dir Valve Off" when the output is Low.

No. 88 in FIG. 9. Digital Output—Brake Valve Status

The Digital Output—Brake Valve status gives the state of digital output 2 which is connected to the Brake Valve. The status will be green with the words "Brake Valve On" when the output is High or it will be grey with the words "Brake Valve Off" when the output is Low.

No. 89 in FIG. 9. Digital Output—Prop Valve Status

The Digital Output—Prop Valve status gives the state of digital output 1 which is connected to the power of the Proportional Valve. The status will be green with the words "Prop Valve On" when the output is High or it will be grey with the words "Prop Valve Off" when the output is Low.

No. 90 in FIG. 9. Digital Output—Buzzer Status

The Digital Output—Buzzer status gives the state of digital output 7 which is connected to the panel buzzer. The status will be green with the words "Buzzer On" when the output is High or it will be grey with the words "Buzzer Off" when the output is Low.

[0300] No. 91 in FIG. 9. Analog Outputs—Valve Output Numerical Display Box The Valve Output numerical display box is used to display the current output in Volts to the proportional valve EVP01 of the Mill-Right System.

No. 92 in FIG. 9. Analog Inputs—Load Cell Numerical Display Box

The Analog Inputs—Load Cell numerical display box is used to display the process signal in mA from the Load Cell.

No. 93 in FIG. 9. Analog Inputs—Injector Brake Pressure Numerical Display Box The Analog Inputs—Injector Brake Pressure numerical display box is used to display the process signal in mA from the Injector Brake pressure transducer.

No. 94 in FIG. 9. Analog Inputs—Hydraulic Pressure Numerical Display Box The Analog Inputs—Hydraulic Pressure numerical display box is used to display the process signal in mA from the Hydraulic Supply pressure transducer.

No. 95 in FIG. 9. Analog Inputs—Circulation Pump Pressure Numerical Display Box The Analog Inputs—Circulation Pump Pressure numerical display box is used to display the process signal in mA from the Circulation Pump pressure transducer.

No. 96 in FIG. 9. Analog Inputs—Skate Pressure Numerical Display Box

The Analog Inputs—Skate Pressure numerical display box is used to display the process signal in mA from the Skate pressure transducer.

No. 97 in FIG. 9. Analog Inputs—Chain Tension Pressure Numerical Display Box The Analog Inputs—Chain Tension Pressure numerical display box is used to display the process signal in mA from the Chain Tension pressure transducer.

No. 98 in FIG. 9. Analog Inputs—Encoder Counts Numerical Display Box

The Analog Inputs—Encoder Counts numerical display box is used to display current counts from the encoder.

No. 99 in FIG. 9. Analog Inputs—Valve Feedback Numerical Display Box

The Analog Inputs—Valve Feedback numerical display box is used to display the process signal in mA from the Proportional Valve Feedback.

Figure 10:
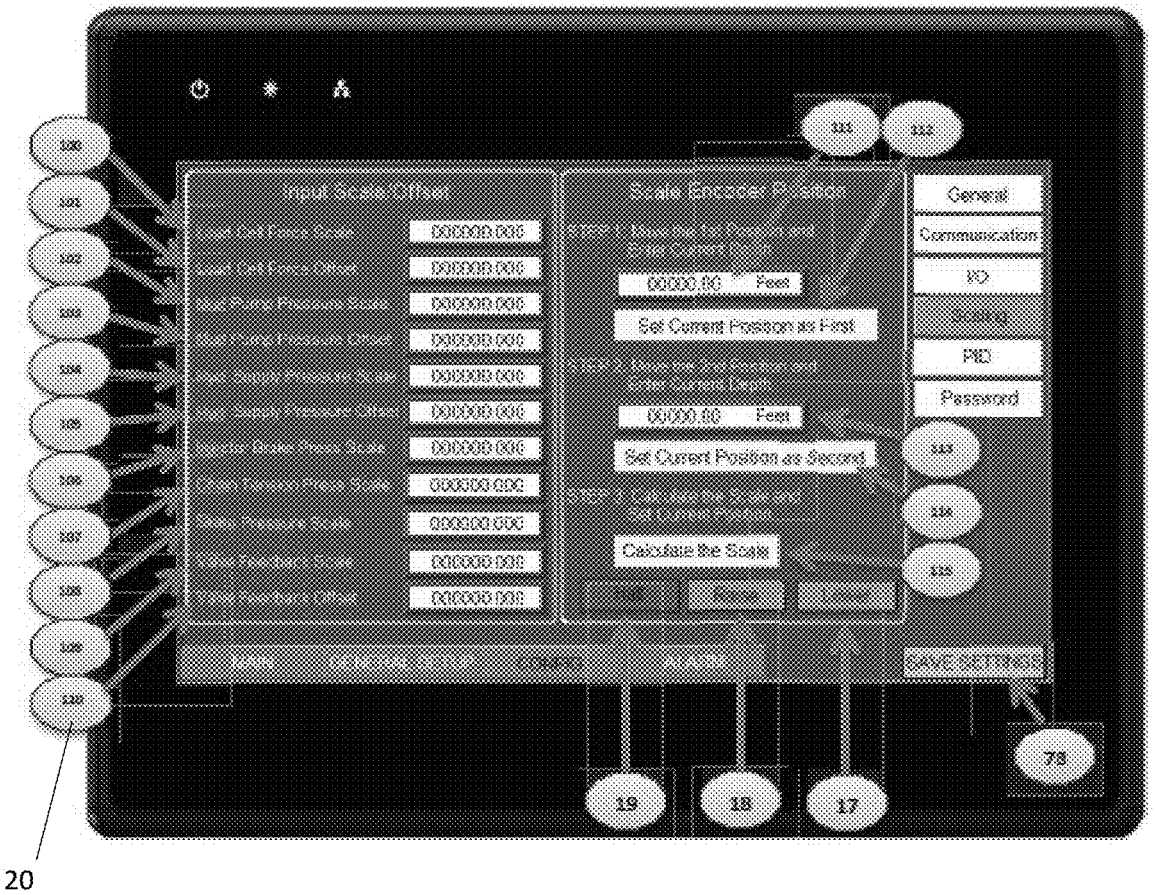
FIG. 10 depicts the configuration-scaling screen of the mill-right system.

4.9 Configuration—Scaling Screen (FIG. 10)

FIG. 10. Configuration—Scaling Screen. Note: The Scaling Screen is not to be altered by field operators. Only to be changed by authorized ARTL technicians. This screen can only be seen when configuration is unlocked by the Master user.

No. 100 in FIG. 10. Load Force Scale Numerical Input Box

The Load Cell Force Scale numerical input box will display the current Load Cell Force Scale as well as it can be used to enter a new Load Cell Force Scale. The Load Cell Force Scale is used as the scaling factor for the conversion of the Load Cell pressure. Note: This should only ever be changed by an ARTL technician.

No. 101 in FIG. 10. Load Cell Force Offset Numerical Input Box

The Load Cell Force Offset numerical input box will display the current Load Cell Force Offset as well as it can be used to enter a new Load Cell Force Offset. The Load Cell Force Offset is used as the offset factor for the conversion of the Load Cell pressure. Note: This should only ever be changed by an ARTL technician.

No. 102 in FIG. 10. Circulation Pump Pressure Scale Numerical Input Box

The Circulation Pump Pressure Scale numerical input box will display the current Circulation Pump Pressure Scale as well as it can be used to enter a new Circulation Pump Pressure Scale. The Circulation Pump Pressure Scale is used as the scaling factor for the conversion of the circulation pump pressure. Note: This should only ever be changed by an ARTL technician.

No. 103 in FIG. 10. Circulation Pump Pressure Offset Numerical Input Box The Circulation Pump Pressure Offset numerical input box will display the current Circulation Pump Pressure Offset as well as it can be used to enter a new Circulation Pump Pressure Offset. The Circulation Pump Pressure Offset is used as the offset factor for the conversion of the circulation pump pressure. Note: This should only ever be changed by an ARTL technician.

No. 104 in FIG. 10. Hyd. Supply Pressure Scale Numerical Input Box

The Hyd. Supply Pressure Scale numerical input box will display the current Hyd. Supply Pressure Scale as well as it can be used to enter a new Hyd. Supply Pressure Scale. The Hyd. Supply Pressure Scale is used as the scaling factor for the conversion of the hydraulic supply pressure. Note: This should only ever be changed by an ARTL technician.

No. 105 in FIG. 10. Hyd. Supply Pressure Offset Numerical Input Box

The Hyd. Supply Pressure Offset numerical input box will display the current Hyd. Supply Pressure Offset as well as it can be used to enter a new Hyd. Supply Pressure Offset. The Hyd. Supply Pressure Offset is used as the offset factor for the conversion of the hydraulic supply pressure. Note: This should only ever be changed by an ARTL technician.

No. 106 in FIG. 10. Injector Brake Pressure Scale Numerical Input Box

The Injector Brake Pressure Scale numerical input box will display the current Injector Brake Pressure Scale as well as it can be used to enter a new Injector Brake Pressure Scale. The Injector Brake Pressure Scale is used as the scaling factor for the conversion of the Injector Brake pressure. Note: This should only ever be changed by an ARTL technician.

No. 107 in FIG. 10. Chain Tension Pressure Scale Numerical Input Box

The Chain Tension Pressure Scale numerical input box will display the current Chain Tension Pressure Scale as well as it can be used to enter a new Chain Tension Pressure Scale. The Chain Tension Pressure Scale is used as the scaling factor for the conversion of the Chain Tension pressure. Note: This should only ever be changed by an ARTL technician.

No. 108 in FIG. 10. Skate Pressure Scale Numerical Input Box

The Skate Pressure Scale numerical input box will display the current Skate Pressure Scale as well as it can be used to enter a new Skate Pressure Scale. The Skate Pressure Scale is used as the scaling factor for the conversion of the Skate pressure. Note: This should only ever be changed by an ARTL technician No. 109 in FIG. 10. Valve Feedback Scale Numerical Input Box The Valve Feedback Scale numerical input box will display the current Valve Feedback Scale as well as it can be used to enter a new Valve Feedback Scale. The Valve Feedback Scale is used as the scaling factor for the conversion of the Valve Feedback to a voltage. Note: This should only ever be changed by an ARTL technician.

No. 110 in FIG. 10. Valve Feedback Offset Numerical Input Box

The Valve Feedback Offset numerical input box will display the current Valve Feedback Offset as well as it can be used to enter a new Valve Feedback Offset. The Valve Feedback Offset is used as the offset factor for the conversion of the Valve Feedback to a voltage. Note: This should only ever be changed by an ARTL technician.

No. 111 in FIG. 10. 1st Position Numerical Input Box

The 1st Position Numerical Input box is used to enter a new current depth as first position for the scaling measurement within the RMC. Note: This should only ever be changed by an ARTL technician.

No. 112 in FIG. 10. Set Current Position as First Button

The Set Current Position as First button is used for the scaling of the position axis from the Configurations—Scaling page. With the Injector at its first position, as identified by the 1st Position Numerical Input Box, pressing this button will store the current encoder count as 1st position for the scaling measurement within the RMC. Note: This should only ever be changed by an ARTL technician.

No. 113 in FIG. 10. 2nd Position Numerical Input Box

The 2nd Position Numerical Input box is used to enter a new current depth as second position for the scaling measurement within the RMC. Note: This should only ever be changed by an ARTL technician.

No. 114 in FIG. 10. Set Current Position as Second Button

The Set Current Position as Second button is used for the scaling of the position axis from the Configurations—Scaling page. With the Injector at its second position, as identified by the 2nd Position Numerical Input Box, pressing this button will store the current encoder count as 2nd position for the scaling measurement within the RMC. Note: This should only ever be changed by an ARTL technician.

No. 115 in FIG. 10. Calculate the Scale Button

The Calculate the Scale button is used to set a new scale based off 1st position and 2nd position as entered by position Numerical Input Box. Note: This should only ever be changed by an ARTL technician 4.10 Configuration-PID Screen (FIG. 11)

Figure 11:
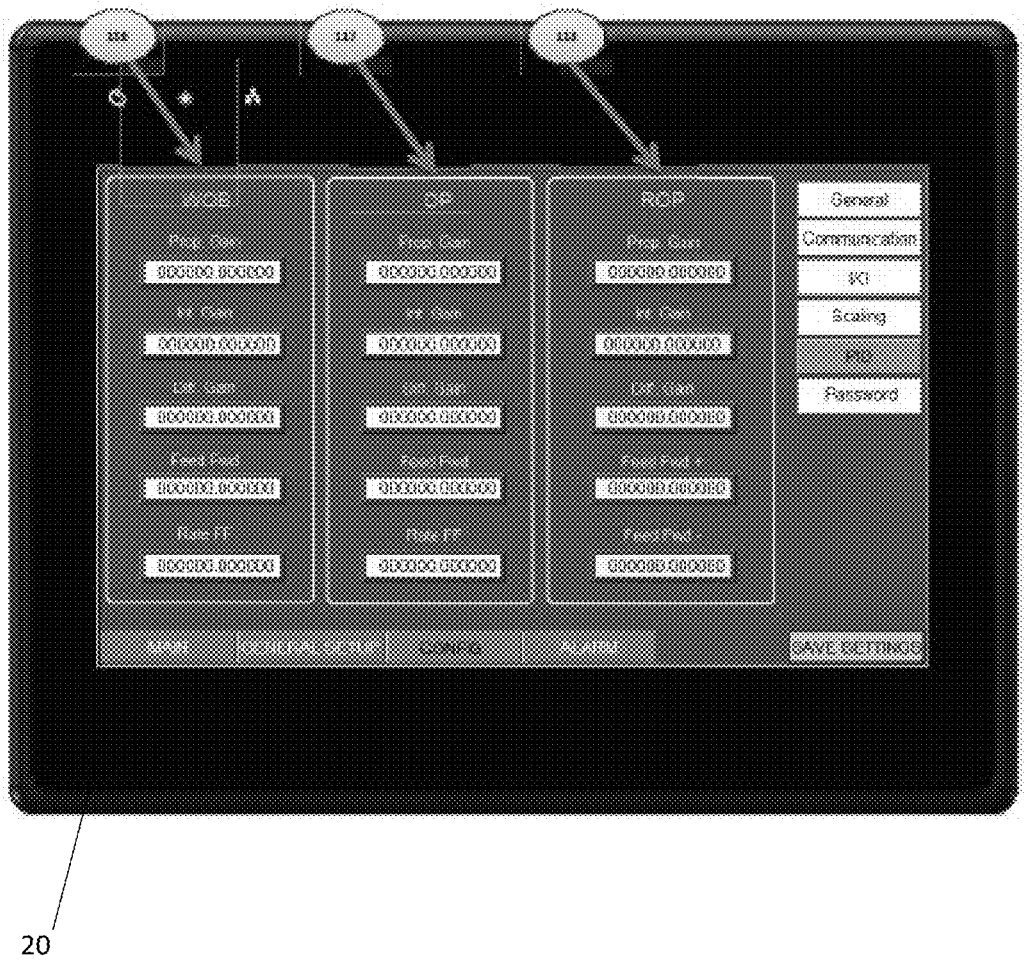
FIG. 11 depicts the configuration-PID screen of the mill-right system.

FIG. 11. Configuration—PID Screen. Note: The PID Screen is not to be altered by field operators. Only to be changed by authorized ARTL technicians. This screen can only be seen when configuration is unlocked by the master user.

No. 116 in FIG. 11. WOB PID Parameters

The WOB PID Parameters are a set of numerical input boxes used to display and change the WOB tuning parameters of the system. To change any parameter press on the button and a keypad will pop up. Enter the desired parameter value into the keypad and press the "ENT" button on the keypad to enter the value. Note: These values are not static and will be overwritten at the start of the next Milling sequence so any changes done while Milling will only affect the current Milling sequence. These parameters should only ever be changed by an ARTL technician.

No. 118 in FIG. 11. ROP PID Parameters

The ROP PID Parameters are a set of numerical input boxes used to display and change the ROP tuning parameters of the system. To change any parameter press on the button and a keypad will pop up. Enter the desired parameter value into the keypad and press the "ENT" button on the keypad to enter the value. Note: These values are not static and will be overwritten at the start of the next Milling sequence so any changes done while Milling will only affect the current Milling sequence. These parameters should only ever be changed by an ARTL technician.

No. 117 in FIG. 11. DP PID Parameters

The DP PID Parameters are a set of numerical input boxes used to display and change the DP tuning parameters of the system. To change any parameter press on the button and a keypad will pop up. Enter the desired parameter value into the keypad and press the "ENT" button on the keypad to enter the value. Note: These values are not static and will be overwritten at the start of the next Milling sequence so any changes done while Milling will only affect the current Milling sequence. These parameters should only ever be changed by an ARTL technician.

Figure 12:
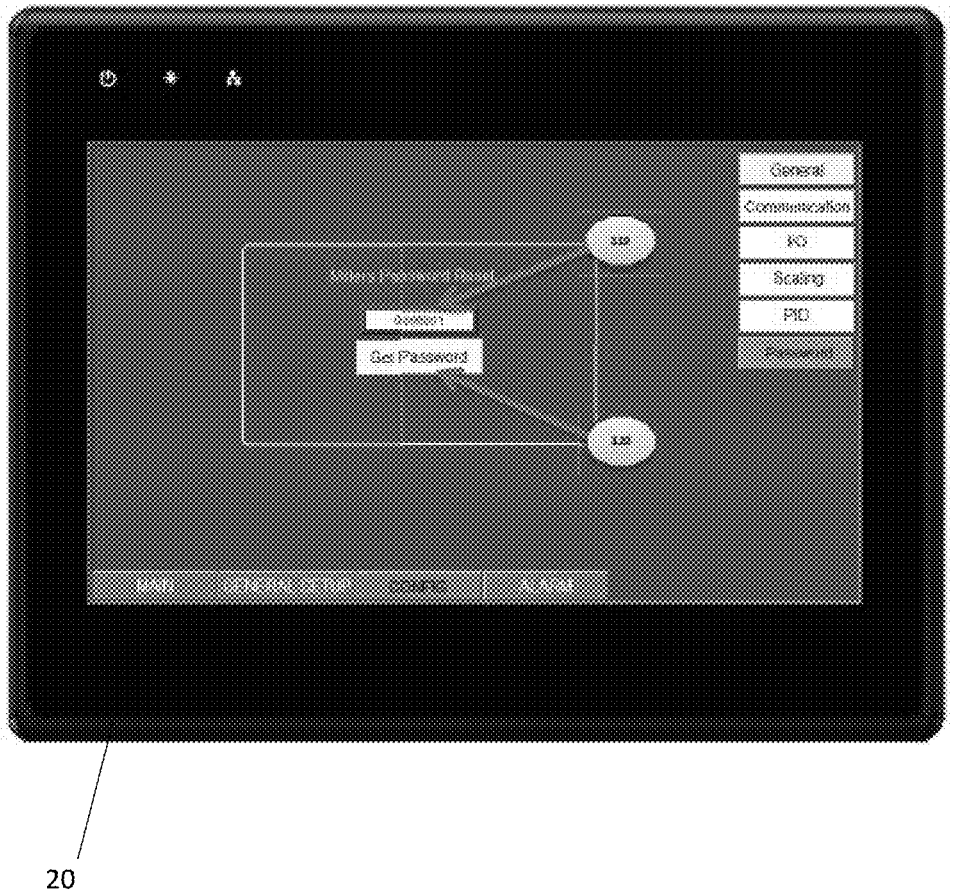
FIG. 12 depicts the configuration-password screen of the mill-right system.

4.11 Configuration—Password Screen (FIG. 12)

FIG. 12. Configuration—Password Screen. Note: This page only accessible if configuration is unlocked by the Miller or master user.

No. 119 in FIG. 12. Password Numerical Input Box

The Password numerical input box will display the current Miller's Password as well as it can be used to enter a new Miller's password. The password is used by the Miller to unlock the system configurations. Note: For the new password to take affect the Set Password button must be pressed.

No. 120 in FIG. 12. Set Password Button

The Set Password button is used to set the password as entered into the Password Numerical Input Box as new Miller's password. While being pressed the button will be green and the word "Done" will be displayed on the button to confirm the operation.

Figure 13:
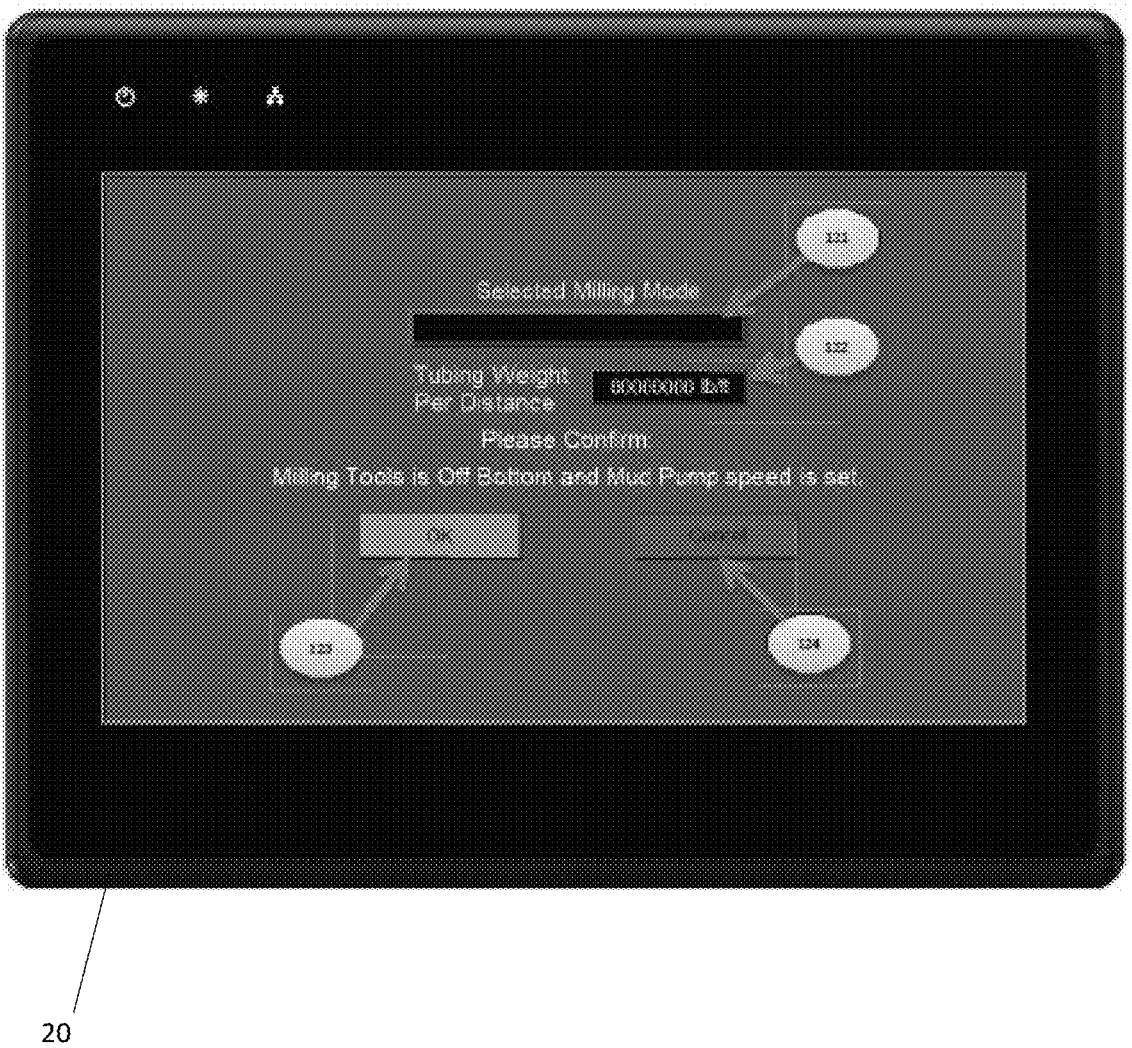
FIG. 13 depicts the confirmation off bottom pump screen of the mill-right system.

5.12 Confirmation Off Bottom Popup (FIG. 13)

FIG. 13. Confirmation Off Bottom Popup. Note: This pop-up occurs when the system is enabled and the start button is pressed. It is used to confirm the milling mode, the tubing weight per distance and that milling tool is off bottom.

No. 121 in FIG. 13. Off Bottom Pop-Up—Selected Milling Mode Text Box

The Selected Milling Mode Text box on the Off Bottom Pop up displays to the Miller the currently selected milling mode. This is shown on the pop up to allow the Miller to confirm which milling mode is selected before a milling sequence begins.

No. 122 in FIG. 13. Tubing Weight per Distance Numerical Display Boxes

The Tubing Weight per distance numerical input boxes display the current Tubing Weight per distance values. This is shown on the pop up to allow the Miller to confirm current tubing weight per distance before a milling sequence begins.

No. 123 in FIG. 13. Off Bottom Pop-Up—OK Button

The OK button on the Off Bottom Pop-up is used to proceed to the Depth Entry pop-up once the Miller has verified the milling mode, the tubing weight per distance and that the milling tool is off bottom.

No. 124 in FIG. 13. Off Bottom Pop-Up—Cancel Button

The Cancel button on the Off Bottom Pop-up is used to close the pop-up and allow the Miller to make changes to the milling mode or the tubing weight per distance before starting a milling sequence.

Figure 14:
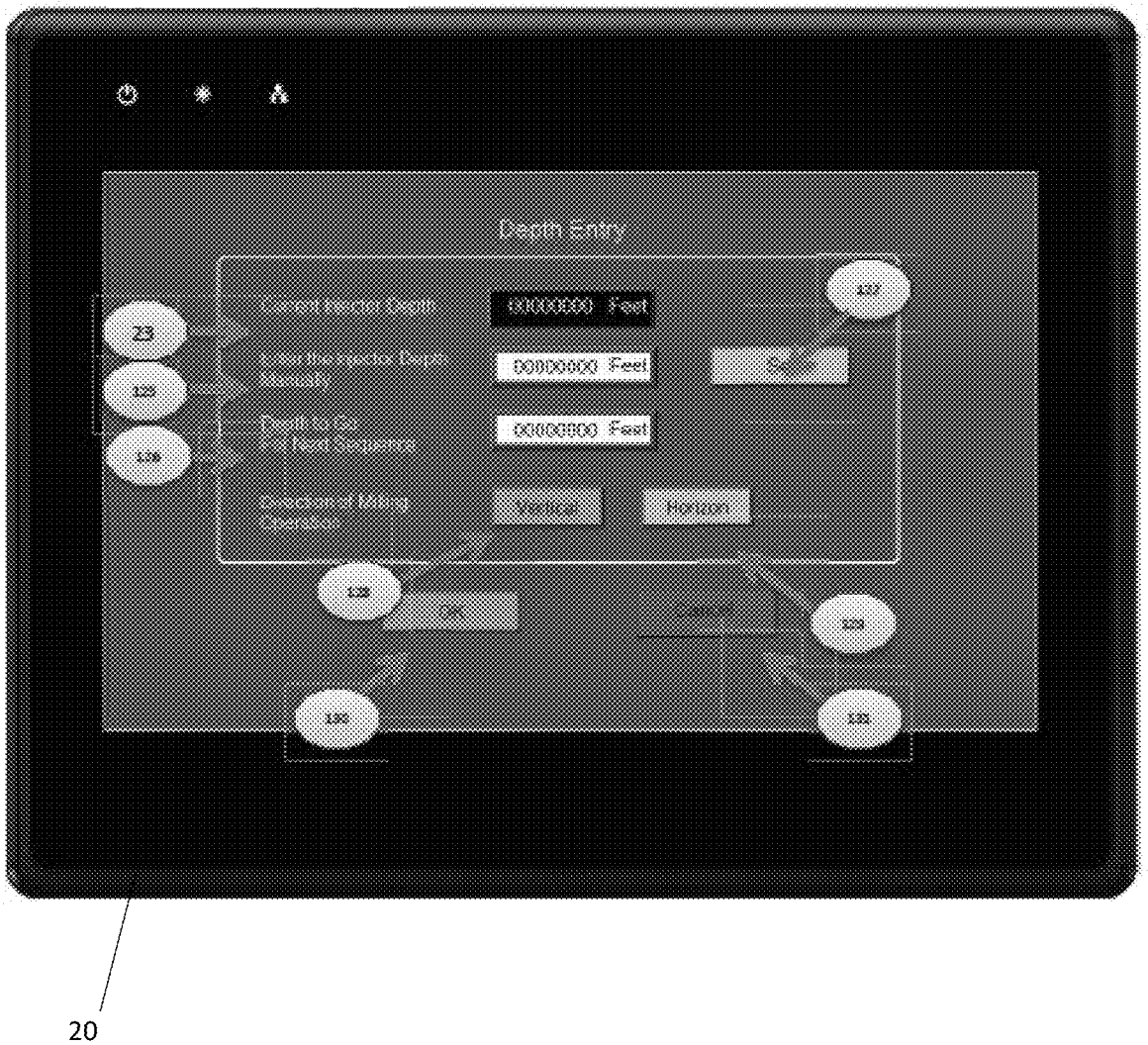
FIG. 14 depicts the depth entry popup screen of the mill-right system.

4.13 Depth Entry Popup (FIG. 14)

FIG. 14. Depth Entry Popup. Note: This pop-up occurs once the Miller confirms that the milling tool is off bottom, the tubing weight per distance and the Circulation Pump speed is set.

No. 125 in FIG. 14. Depth Entry Pop-Up—Injector Depth Manually Numerical Input Box The Injector Depth entered into this box will be shown above current injector depth display box as well as used as the current Injector Depth if the Set button is pressed. Note: If a depth is not entered into the numerical input box the value shown in the Current Injector Depth display box 23 will be taken as current depth to begin a milling sequence.

No. 126 in FIG. 14. Depth Entry Pop-Up—Depth to Go Numerical Input Box

The Depth to Go for Next sequence entered into this box will be used as the point to complete this milling sequence.

No. 127 in FIG. 14. Depth Entry Pop-Up—Set Button

The Set button will store the value entered into box 125 as the current depth. Note: The current injector depth is used for calculating distance how far the coil tubing should go during Mill-Right sequence.

No. 128 in FIG. 14. Depth Entry Pop-Up—Vertical Button

The Vertical button on the Depth Entry Pop-up is used to calculate and to update the coil tubing weight during Mill-Right sequence. (coil tubing weight=coil tubing weight per distance*(current depth—starting depth)+off bottom weight). Note: starting depth and off bottom weight will be stored once automatically before starting a milling sequence while current depth will be updated every cycle until completing a milling sequence.

No. 129 in FIG. 14. Depth Entry Pop-Up—Horizon Button

The Horizon button on the Depth Entry Pop-up is used to calculate and to update the coil tubing weight during Mill-Right sequence. (coil tubing weight=off bottom weight) Note: Off bottom weight will be stored once automatically before starting a milling sequence No. 130 in FIG. 14. Depth Entry Pop-Up—OK Button The OK button will start the Milling sequence with the parameter setting above as well as close the pop-up. Note: The OK button will be denied to press if neither direction of milling operation is chosen.

No. 131 in FIG. 14. Depth Entry Pop-Up—Cancel Button

The Cancel button on the Depth Entry Pop-up is used to close the pop-up and allow the Miller to make changes to the milling mode or setting before starting a milling sequence.

Figure 15:
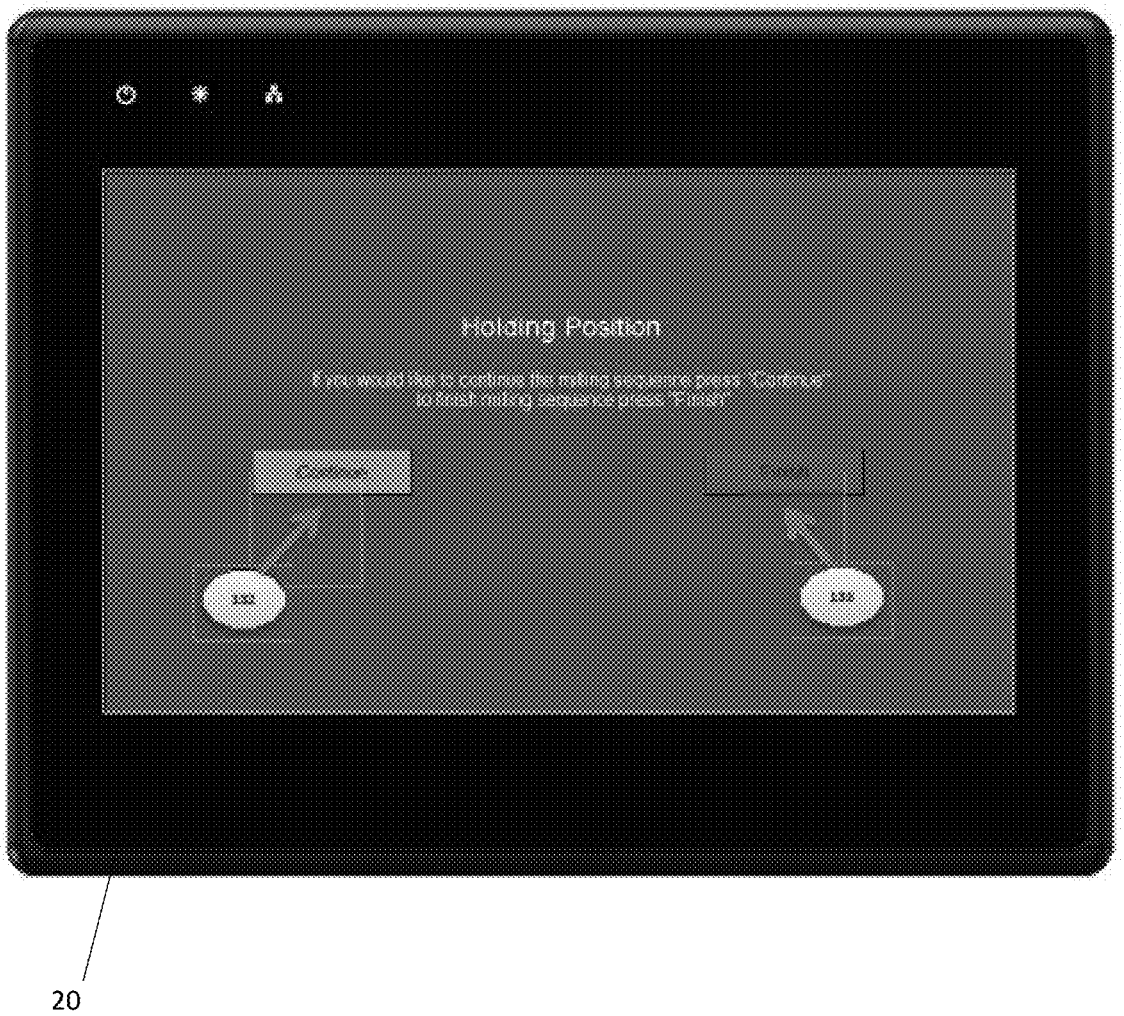
FIG. 15 depicts the hold position pump screen of the mill-right system.
Figure 16:
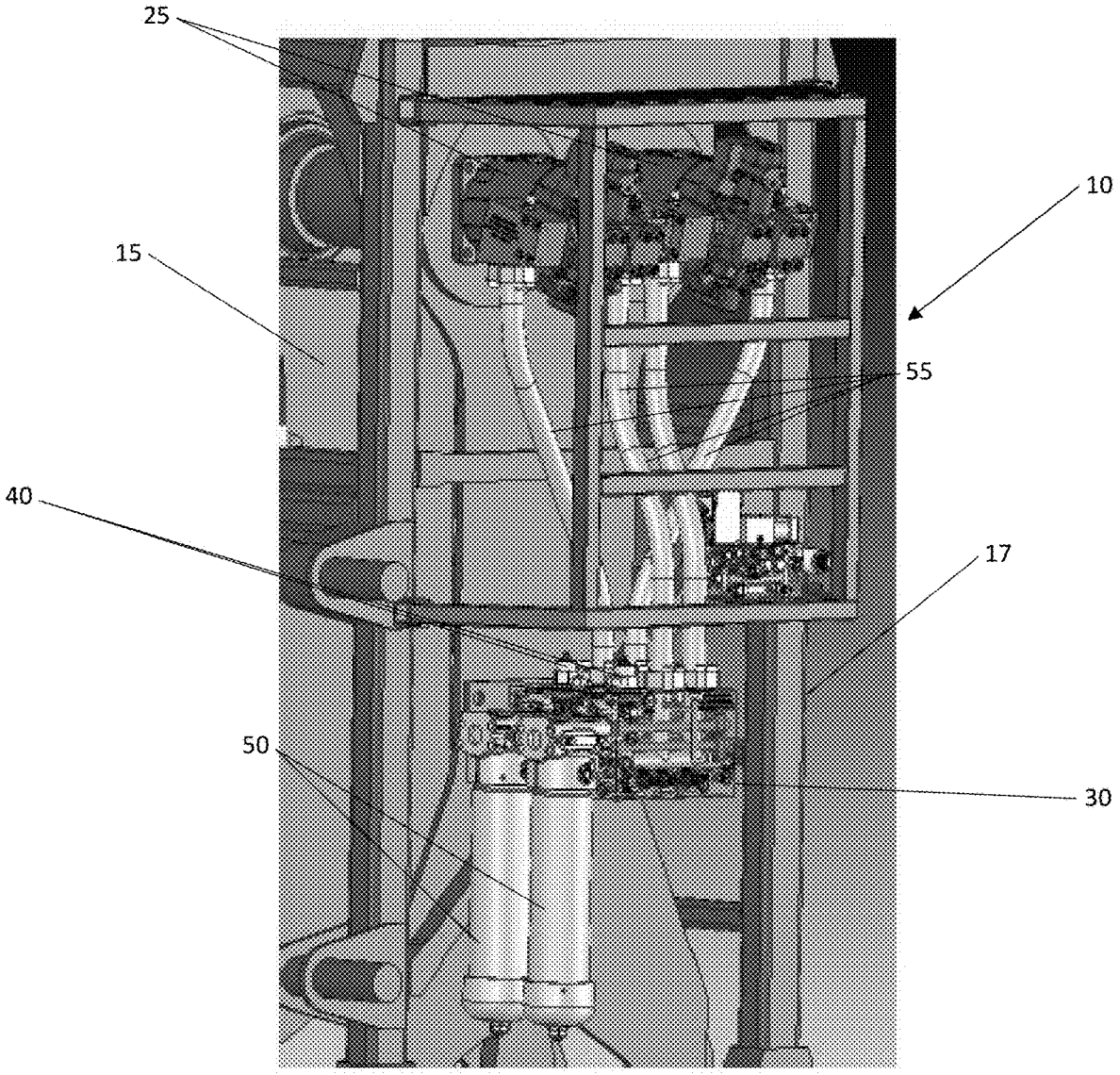
FIG. 16 depicts the major hydraulic components of the mill-right system.

4.14 Hold Position Popup (FIG. 15)

FIG. 15. Hold Position Popup. Note: This pop-up will occurs when the Hold Position button is pressed.

No. 132 in FIG. 15. Hold Position Pop-Up—Continue Button

The Continue button will continue the Milling Sequence after stopping it with the Hold Position button.

No. 133 in FIG. 15. Hold Position Pop-Up—Finish Button

The Finish button on the Hold Position Pop-up is used to stop the Milling sequence at the current depth and close the pop-up.

5.0 Mill-Right system 10 Setup

Note: The steps in this section refer to all the system General Setup that needs to be setup prior to starting a milling sequence. Some General Setup may have been entered during testing and commissioning but should be checked prior to system use.

5.1. Alarm Setpoint Values

The alarm Setpoint values are used to alarm and shutdown the system when an alarming criteria occurs.

1. Go to the Configuration—General page (FIG. 7) as discussed above.

2. Unlock the Configuration by selecting the user and inputting the associated user's password.

3. Press on the Circulation Pump Supply Low Numerical Input Box (No. 55), on the keypad pop-up enter the desired Circulation Pump Supply Low alarm value and press 'ENT' to enter the value and close the pop-up.

4. Press on the Circulation Pump Supply High Numerical Input Box (No. 56), on the keypad pop-up enter the desired Circulation Pump Supply High alarm value and press 'ENT' to enter the value and close the pop-up.

5. Press on the Hydraulic Supply Low Numerical Input Box (No. 57), on the keypad pop-up enter the desired Hydraulic Supply Low alarm value and press 'ENT' to enter the value and close the pop-up.

6. Press on the Hydraulic Supply High Numerical Input Box (No. 58), on the keypad pop-up enter the desired Hydraulic Supply High alarm value and press 'ENT' to enter the value and close the pop-up.

7. Press on the Chain Tension Low Numerical Input Box (No. 59), on the keypad pop-up enter the desired Chain Tension Low alarm value and press 'ENT' to enter the value and close the pop-up.

8. Press on the Injector Brake Low Numerical Input Box (No. 60), on the keypad pop-up enter the desired Injector Brake Low alarm value and press 'ENT' to enter the value and close the pop-up.

9. Press on the Skate Low Numerical Input Box (No. 61), on the keypad pop-up enter the desired Skate Low alarm value and press 'ENT' to enter the value and close the pop-up.

10. Press on the Max Valve Deviation Numerical Input Box (No. 62), on the keypad pop-up enter the desired Max Valve Deviation alarm value in Volts and press 'ENT' to enter the value and close the pop-up.

11. Lock the Configuration by pressing the Configuration Status Button (No. 74).

5.2. Alarm Setpoint Debounce Time as discussed above with respect to FIG. 5.

The alarm Setpoint debounce times are used as delay for how long a parameter must be above an alarming value for the system to alarm.

1. Go to the Configuration—General page.

2. Unlock the Configuration by selecting the user and inputting the associated user's password.

3. Press on the WOB Alarm Setpoint Debounce Numerical Input Box, on the keypad pop-up enter the desired debounce time for the WOB alarm and press 'ENT' to enter the value and close the pop-up.

4. Press on the ROP Alarm Setpoint Debounce Numerical Input Box, on the keypad pop-up enter the desired debounce time for the ROP alarm and press 'ENT' to enter the value and close the pop-up.

5. Press on the DP Alarm Setpoint Debounce Numerical Input Box, on the keypad pop-up enter the desired debounce time for the DP alarm and press 'ENT' to enter the value and close the pop-up.

6. Press on the Valve Feedback Alarm Setpoint Debounce Numerical Input Box, on the keypad pop-up enter the desired debounce time for the Valve Feedback alarm and press 'ENT' to enter the value and close the pop-up.

7. Press the Save General Setup button to save the General Setup.

8. Lock the Configuration by pressing the Configuration Status Button.

5.3. Raising and Lowering Outputs as discussed above with respect to FIG. 7.

The Raising and Lowering Output values are the voltage that will be sent to the proportional valve while operating the top drive using the Mill-Right's Raise and Lower buttons.

1. Go to the Configuration—General page.

2. Unlock the Configuration by selecting the user and inputting the associated user's password.

3. Press on the Raising Output Numerical Input Box, on the keypad pop-up enter the desired raising output and press 'ENT' to enter the value and close the pop-up. Note: Value must be between 0-10V.

4. Press on the Lowering Output Numerical Input Box, on the keypad pop-up enter the desired lowering output and press 'ENT' to enter the value and close the pop-up. Note: Value must be between −10-0V.

5. Press the Save General Setup button to save the General Setup.

6. Lock the Configuration by pressing the Configuration Status Button.

5.4. Set Tubing Weight as discussed above with respect to FIG. 7.

The tubing weight per distance is used for calculating a current tubing weight based off distance.

1. Go to the Configuration—General page.

2. Unlock the Configuration by selecting the user and inputting the associated user's password.

3. Press on the Tubing Weight per Distance Numerical Input Box, on the keypad pop-up enter the desired tubing weight per distance and press 'ENT' to enter the value and close the pop-up.

4. Press the Save General Setup button to save the General Setup.

5. Lock the Configuration by pressing the Configuration Status Button.

5.5. Milling Modes as discussed above with respect to FIG. 5.

There is the ability to setup 10 different milling modes within the system. Each milling mode can be quickly selected before beginning a milling Sequence to allow the Miller to quickly change between various setpoints and parameters.

1. Go to the HMI—Configuration General Screen and unlock the HMI configurations. Note: This needs to be done to make changes to the Milling Modes.

2. Go to the HMI—General Setup page.

3. Press the Select button next to the Milling Mode you wish to edit. Note: The selected Milling Mode will be displayed in the Milling Mode Select text box, however if the selected Milling Mode has not yet been named the Milling Mode Select text box will be blank even though an unnamed Milling Mode has been selected.

4. Press the Change General Setup button to get to the Milling Mode Setting screen for the selected Milling Mode.

5. To name/re-name the Milling Mode press on the Milling Mode General Setup text input box to open the keyboard. Enter the desired name into the keyboard and press the "Enter" button to accept the name change.

6. To enter/change the WOB Max Value press on the numerical display box and enter the desired value on the keypad pop-up and press the "ENT" button to enter the value. Note: The value entered as the Max Value is used as the upper limit for the Alarm, Warning and Setpoint values.

7. To enter/change the WOB Alarm Value press on the numerical display box and enter the desired value on the keypad pop-up and press the "ENT" button to enter the value. Note: The Alarm Value is used as the value at which the system will alarm if the WOB Actual value is above it for longer than the Debounce Time.

8. To enter/change the WOB Warning Value press on the numerical display box and enter the desired value on the keypad pop-up and press the "ENT" button to enter the value. Note: The Warning Value is used as the value at which the system will warn the user if the WOB Actual value is above it.

9. To enter/change the WOB Setpoint press on the numerical display box and enter the desired value on the keypad pop-up and press the "ENT" button to enter the value.

10. To enter/change the WOB Min Value press on the numerical display box and enter the desired value on the keypad pop-up and press the "ENT" button to enter the value. Note: The value entered as the Min Value is used as the lower limit for the Alarm, Warning and Setpoint values.

11. To enable/disable the WOB axis press on the WOB Status button and then click "Ok" on the confirmation pop-up. Note: This axis setting is the default for when the Milling Mode is first selected, but the axis can be enabled/disabled from the HMI—Main screen at any time during operation.

12. To enter/change the ROP Max Value press on the numerical display box and enter the desired value on the keypad pop-up and press the "ENT" button to enter the value. Note: The value entered as the Max Value is used as the upper limit for the Alarm, Warning and Setpoint values.

13. To enter/change the ROP Alarm Value press on the numerical display box and enter the desired value on the keypad pop-up and press the "ENT" button to enter the value. Note: The Alarm Value is used as the value at which the system will alarm if the ROP Actual value is above it for longer than the Debounce Time.

14. To enter/change the ROP Warning Value press on the numerical display box and enter the desired value on the keypad pop-up and press the "ENT" button to enter the value. Note: The Warning Value is used as the value at which the system will warn the user if the ROP Actual value is above it.

15. To enter/change the ROP Setpoint press on the numerical display box and enter the desired value on the keypad pop-up and press the "ENT" button to enter the value.

16. To enter/change the ROP Min Value press on the numerical display box and enter the desired value on the keypad pop-up and press the "ENT" button to enter the value. Note: The value entered as the Min Value is used as the lower limit for the Alarm, Warning and Setpoint values.

17. To enable/disable the ROP axis press on the ROP Status button and then click "Ok" on the confirmation pop-up. Note: This axis setting is the default for when the Milling Mode is first selected but the axis can be enabled/disabled from the HMI—Main screen at any time during operation.

18. To enter/change the DP Max Value press on the numerical display box and enter the desired value on the keypad pop-up and press the "ENT" button to enter the value. Note: The value entered as the Max Value is used as the upper limit for the Alarm, Warning and Setpoint values.

19. To enter/change the DP Alarm Value press on the numerical display box and enter the desired value on the keypad pop-up and press the "ENT" button to enter the value. Note: The Alarm Value is used as the value at which the system will alarm if the DP Actual value is above it for longer than the Debounce Time.

20. To enter/change the DP Warning Value press on the numerical display box and enter the desired value on the keypad pop-up and press the "ENT" button to enter the value. Note: The Warning Value is used as the value at which the system will warn the user if the DP Actual value is above it.

21. To enter/change the DP Setpoint press on the numerical display box and enter the desired value on the keypad pop-up and press the "ENT" button to enter the value.

22. To enter/change the DP Min Value press on the numerical display box and enter the desired value on the keypad pop-up and press the "ENT" button to enter the value. Note: The value entered as the Min Value is used as the lower limit for the Alarm, Warning and Setpoint values.

23. To enable/disable the DP axis press on the DP Status button and then click "Ok" on the confirmation pop-up. Note: This axis setting is the default for when the Milling Mode is first selected, but the axis can be enabled/disabled from the HMI—Main screen at any time during operation.

24. Save the Milling Mode by pressing the "Save" button.

6.0 Mill-Right "How—To"

6.1. Start a Milling Sequence

Before starting a Milling sequence ensure that the Tubing Weight per Distance and Alarm General Setup are set as desired.

1. Turn on the circulation pump and set desired pump rate.

2. Lift the Milling tool off bottom using the injector joystick. Put injector joystick in the neutral position.

3. On the HMI General Setup screen select the desired Milling Mode for the Milling Sequence as discussed above with respect to FIG. 5.

4. Turn the On/Off switch to the "On" position.

5. Press the Start Button. Note: There is a 3 second delay from the time the On/Off switch is switched to the "On" position and the Start button is active.

6. Once the Start Button is pressed the Start Milling pop-up will appear on the HMI prompting the user to ensure the Milling tool is off bottom, the circulation pump speed and tubing weight per distance are set.

7. Press the "OK" button on the pop-up and the Depth Entry pop-up will occur.

8. Select Depth Entry Mode a. To keep the current injector depth skip the next step 8b b. To manually enter injector depth enter the desired depth into the numerical input box and press the set button to store as current depth.

9. Select Milling Direction a. Press the "Vertical" button on the pop-up if the milling direction is in vertical for next sequence.

b. Press the "Horizon" button on the pop-up if the milling direction is horizontal for the next sequence.

10. Press the "OK" button on the pop-up and the Auto Milling sequence will begin. Note: If the ROP axis is disabled the Mill-Right will maintain the max ROP of 0.16 m/min or 0.525 feet/min while finding bottom. Once the bottom is found the system will only limit based on the enabled axis/axes.

11. The Mill-Right will control the rate of the Milling sequence based off maintaining the setpoints of the enabled axis.

12. At any time during the Milling sequence the setpoint can be changed by using the "+" and "–" buttons or by clicking on the setpoint numerical display box and entering the value on the keypad. Once entered press the "ENT" button to enter the new setpoint.

13. Once the injector reaches the depth limit the Milling Completed pop-up will appear on the screen. Press the "Ok" button to confirm the completion of the Milling Sequence and turn the On/Off switch to the "Off" position.

6.2. Unlock Configurations

There are various functions within the Mill-Right system that require the system configurations to be unlocked to gain access to the function.

1. Go to the Configuration—General screen.

2. Select the user by pressing the Miller or Master button based on which user you are unlocking the configuration for. Note: The current selected user will have a green button with the word "Selected" displayed on the button.

3. Press on the User Password numerical input box and enter the password on the keypad for the selected user and press the "ENT" button to enter it.

4. If password is accepted and the configuration unlocks the Configuration Status button will go from red to green.

5. To re-lock the configurations press on the Configuration Status button and the button will go from green to red.

6.3. Change System Units

1. Go to the Configuration—General screen

2. Unlock the Configuration

3. Press the Change Units button.

4. The units will change from Imperial to Metric or Metric to Imperial based upon what units the system was in.

5. Lock the Configuration by pressing the Configuration Status Button 6.4. Scale a New Encoder When a new encoder is installed the system must be scaled to the new encoder. Before the scaling is completed all measured distances and speeds within the system will not be accurate and the Mill-Right should not be operated.

1. With the On/Off switch in the "Off" position.

2. Go to the Configuration—General screen

3. Unlock the Configuration for the Master User. Note: Rig Manager should have master password for the Mill-Right system. If Rig Manager does not have the master password, please contact the manufacturer.

4. Go to the Configuration—Scaling screen. Note: This page is unavailable unless the configuration is unlocked for the Master User.

5. Using the injector joystick on the control panel move the coil tubing to the first position.

6. Physically mark the current depth of coil tubing on the injector. This mark will be used to measure the distance between the first position and the second position.

7. Press on the 1st Position numerical input box and enter the value as current position then press the Set Current Position as First button. Note: The unit of measure for the distance will be based on what units the system is currently in. If in metric the unit of measure is meters, if in imperial the unit of measure is feet.

8. Using the injector joystick on the control panel move the coil tubing to the second position.

Note: The distance between the first position and the second position needs to be accurately measured so ensure a measurement is possible in the second position. The scaling will be more accurate the further the distance between the two positions.

9. Measure the distance between the first position and the second position.

10. Press on the 2nd position numerical input box and enter the value as current position then press the Set Current Position as Second button. Note: The unit of measure for the distance will be based on the units currently selected for the system. If in metric the unit of measure is meters, if in imperial the unit of measure is feet.

11. Press the Calculate the Scale button.

12. Go to the Configuration General screen and lock the Configuration by pressing the Configuration Status Button 13. Using the injector joystick on the control panel move the coil tubing and confirm that the Injector Depth as seen on the Main screen accurately tracks the coil tubing movement.

7.0 Alarms

When an alarm is triggered the Mill-Right system will disable and a pop-up will occur on the HMI panel to display the cause of the alarm. To reset the Mill-Right cycle the On/Off switch Off and back On to reset an alarm. If the cause of the alarm is still present the system will alarm again. If the cause of the alarm has been remedied the system will be enabled.

7.1. Emergency Stop

Causes:

1. The Mill-Right has received an emergency stop signal from the injector control panel. The emergency stop signal can be caused by any rig shutdown event while the Mill-Right is enabled. The emergency rig shutdown events are Hydraulic Tank Low Level, Hydraulic Tank High Temperature, Gearbox High Temperature, and Gearbox pressure.

Troubleshooting:

1. Check that the Injector Control Panel is On.

2. Check that no injector shutdown events are present.

7.2. Reel Brake

Causes:

1. The Mill-Right has received a reel brake signal from the injector control panel. The reel brake signal can be caused by either operator hit the button or hydraulic pressure is lost while the Mill-Right is enabled.

Troubleshooting:

1. Check that the reel brake button in the Injector Control Panel is On.

2. Check that hydraulic pressure is present.

7.3. RMC Communication Was Lost

Causes:

1. The Mill-Right HMI panel is not communicating with the main control panel while the Mill-Right is enabled.

Troubleshooting:

1. Check that communication cable CK-HMI01 is connected to the HMI panel.

2. Check that communication cable CK-HMI01 is connected to the Main Control Panel.

3. Check that the RMC controller is powered:

a. Open the main control panel and check that the CPU light on the RMC is on. b. If light is off check that that CB2-2A is closed.

c. If CB2 is closed and the RMC CPU light is still off call The manufacturer.

4. Check that the Ethernet switch is powered:

a. Open the main control panel and check that the Power light on the switch is on. b. If light is off check that CB4-0.5A is closed.

c. If CB4 is closed and the switch CPU light is still off call The manufacturer.

7.4. Circulation Pump Supply Pressure Low

Causes:

1. The current standpipe pressure is below the Circulation Pump Supply Low Alarm Setpoint while the Mill-Right is enabled.

2. The Circulation Pump Signal is missing. If signal is missing the Circulation Pump Signal Missing alarm will Setpoint at the same time and that alarm should be troubleshot before this alarm.

Troubleshooting:

1. Check that the circulation pump is running and confirm pressure is present on the Injector control panel.

2. Check that the Circulation Pump Low Setpoint value is set accordingly for the pump pressure as seen in step 1.

3. Compare the Pump pressure as seen on injector control panel to the Pump Pressure as seen on the main HMI screen. If the pressure on the HMI does not match the pump pressure on the injector control panel, contact the manufacturer.

7.5. Circulation Pump Supply Pressure High

Causes:

1. The current standpipe pressure is above the Circulation Pump Supply High Alarm Setpoint while the Mill-Right is enabled.

Troubleshooting:

1. Check that the circulation pump is running and confirm pressure is present on the injector control panel.

2. Check that the Circulation Pump High Setpoint value is set accordingly for the pump pressure as seen in step 1.

3. Compare the Pump pressure as seen on injector control panel to the Pump Pressure as seen on the main HMI screen. If the pressure on the HMI does not match the pump pressure on the injector control panel, contact the manufacturer.

7.6. Switched to Joystick Control

Causes:

1. The injector joystick on the injector control panel has been moved off center while the Mill-Right is enabled.

Troubleshooting:

1. Check that injector joystick is in the neutral position.

2. If alarm is still triggering with the joystick in neutral contact the manufacturer.

7.7. ROP High Level Alarm

Causes:

1. The actual ROP of the Injector is above the ROP Alarm value for longer than the ROP Setpoint Debounce Time during a Milling sequence. Note: That even if the ROP axis is disabled the ROP alarm is active in the background.

Troubleshooting:

1. If the ROP axis is disabled set the ROP alarm setpoint value high enough to not alarm while milling off WOB and/or DP axis.

2. If the ROP axis is enabled and the actual ROP is maintaining the setpoint but the alarm is being set check that the ROP Alarm value is set above the ROP setpoint.

3. If the ROP axis is enabled and the actual ROP is spiking to cause the alarm to set, if the spikes are deemed acceptable to the Milling sequence then increase the ROP setpoint Debounce Time.

4. If the ROP axis is enabled and the actual ROP is consistently going above the setpoint and setting off the alarm, tuning of the system may be required. Contact the manufacturer.

7.8. WOB High Level Alarm

Causes:

1. The actual WOB of the system is above the WOB Alarm value for longer than the WOB Setpoint Debounce Time during a Milling sequence. Note: That even if the WOB axis is disabled the WOB alarm is active in the background.

Troubleshooting:

1. If the WOB axis is disabled set the WOB alarm setpoint value high enough to not alarm while milling off the ROP and/or DP axis.

2. If the WOB axis is enabled and the actual WOB is maintaining the setpoint but the alarm is being set check that the WOB Alarm value is set above the WOB setpoint.

3. If the WOB axis is enabled and the actual WOB is spiking to cause the alarm to set, if the spikes are deemed acceptable to the Milling sequence then increase the WOB setpoint.

Debounce Time.

4. If the WOB axis is enabled and the actual WOB is consistently going above the setpoint and setting off the alarm, tuning of the system may be required. Contact the manufacturer.

7.9. DP High Level Alarm

Causes:

1. The actual DP of the system is above the DP Alarm value for longer than the DP Setpoint Debounce Time during a Milling sequence. Note: That even if the DP axis is disabled the DP alarm is active in the background.

2. The Mill-Right Off Bottom Pump pressure was set while circulation pump was not running or the pump was not up to speed giving a false reading.

Troubleshooting:

1. Before starting the next Milling sequence ensure the coil tubing is off bottom and the circulation pump is running. Then on the General Setup screen press the Reset WOB and DP button. Note: This solution will only work if the Off Bottom Pressure has been set while the circulation pump was not running.

2. If the DP axis is disabled set the DP alarm Setpoint value high enough to not alarm while Milling off the ROP and/or WOB axis.

3. If the DP axis is enabled and the actual DP is maintaining the setpoint but the alarm is being set check that the DP Alarm value is set above the DP setpoint.

4. If the DP axis is enabled and the actual DP is spiking to cause the alarm to set, if the spikes are deemed acceptable to the Milling sequence then increase the DP Setpoint Debounce Time.

5. If the DP axis is enabled and the actual DP is consistently going above the setpoint and setting off the alarm, tuning of the system may be required. Contact the manufacturer.

7.10. Valve Output/Feedback Mismatch

Causes:

1. The spool feedback from the proportional valve is off from the output voltage sent to the proportional valve by more than the Max Valve Deviation for longer than the Alarm Setpoint Debounce time during a Milling sequence.

Troubleshooting:

1. Tap on the proportional valve with a wrench to try and dislodge any debris that may be preventing the spool from moving through its range.

2. Contact the manufacturer.

7.11. Encoder Signal Missing

Causes:

1. The RMC controller is not receiving a signal from the encoder while the Mill-Right is enabled.

Troubleshooting:

1. Open the Main control panel and check that CB5-1A is closed.

2. Check the cable run JK-JB01 from the Main Control Panel is in good condition and is plugged into the Injector Junction Box.

3. Check that cable JK-ZIT01 from the junction box is in good condition and plugged into the encoder.

[0600] 4. Contact the manufacturer.

7.12. Load Cell Signal Missing

Causes:

1. The RMC controller is not receiving a signal from the Load Cell while the Mill-Right is enabled.

Troubleshooting:

1. Open the Main control panel and check that CB5-1A is closed.

2. Check the cable run JK-JB01 from the Main Control Panel is in good condition and is plugged into the Injector Junction Box.

3. Check that cable JK-WIT01 from the Injector junction box is in good condition and plugged into the load cell.

4. Contact the manufacturer.

7.13. Hydraulic Pressure Signal Missing

Causes:

1. The RMC controller is not receiving a signal from the hydraulic supply pressure transducer while the Mill-Right is enabled.

Troubleshooting:

1. Open the Main control panel and check that CB5-1A is closed.

2. Check the cable run JK-JB01 from the Main Control Panel is in good condition and is plugged into the Injector Junction Box.

3. Check that cable JK-PT03-1 from the Injector junction box is in good condition and plugged into the hydraulic supply pressure transducer.

4. Contact Manufacturer.

7.14. Injector Brake Pressure Signal Missing

Causes:

1. The RMC controller is not receiving a signal from the Injector brake pressure transducer while the Mill-Right is enabled.

Troubleshooting:

1. Open the Main control panel and check that CB11-0.5A is closed.

2. Check the cable run JK-PT02 from the Main Control Panel is in good condition and is plugged into the Injector brake pressure transducer.

3. Contact the manufacturer.

7.15. Chain Tension Pressure Signal Missing

Causes:

1. The RMC controller is not receiving a signal from the Chain Tension pressure transducer while the Mill-Right is enabled.

Troubleshooting:

1. Open the Main control panel and check that CB11-0.5A is closed.

2. Check the cable run JK-PT03-3 from the Main Control Panel is in good condition and is plugged into the Chain Tension pressure transducer.

3. Contact the manufacturer.

7.16. Skate Pressure Signal Missing

Causes:

1. The RMC controller is not receiving a signal from the Skate pressure transducer while the Mill-Right is enabled.

Troubleshooting:

1. Open the Main control panel and check that CB11-0.5A is closed.

2. Check the cable run JK-PT03-2 from the Main Control Panel is in good condition and is plugged into the Skate pressure transducer.

3. Contact the manufacturer.

7.17. DP Pressure Signal Missing

Causes:

1. The RMC controller is not receiving a signal from the circulation pump pressure transducer while the Mill-Right is enabled.

Troubleshooting:

1. Open the Main control panel and check that CB11-0.5A is closed.

2. Check that cable JK-PT01 from the Main Control Panel is in good condition and plugged into the circulation pump pressure transducer.

3. Contact the manufacturer.

7.18. Valve Feedback Signal Missing

Causes:

1. The RMC controller is not receiving the spool feedback signal from the proportional valve while the Mill-Right is enabled.

Troubleshooting:

1. Open the Main control panel and check that CB9-2A is closed.

2. Check that the light on relay DR2 is on indicating the relay is active.

3. Check the cable run JK-JB01 from the Main Control Panel is in good condition and is plugged into the Injector Junction Box.

4. Check that cable JK-EVP01 from the Injector junction box is in good condition and plugged into the proportional valve.

5. Contact the manufacturer.

7.19. Hydraulic Supply Pressure Low

Causes:

1. The hydraulic supply pressure is below the Hydraulic Supply Low Alarm setpoint while the Mill-Right is enabled.

2. The hydraulic supply signal is missing. If the signal is missing the Hydraulic Supply Signal Missing alarm will trigger at the same time and that alarm should be troubleshot before this alarm.

Troubleshooting:

1. Check that the HPU is running and confirm pressure is present on port TP-P on the directional control manifold.

2. Check that the Hydraulic Supply Low value is set accordingly for the actual hydraulic supply pressure as seen in step 1.

3. Compare the Hydraulic Supply pressure as seen on a manual gauge to the Hydraulic Supply as seen on the HMI General Setup screen. If the pressure on the HMI does not match the supply pressure on the gauge, contact the manufacturer.

7.20. Hydraulic Supply Pressure High

Causes:

1. The hydraulic supply pressure is above the Hydraulic Supply High Alarm setpoint while the Mill-Right is enabled.

Troubleshooting:

1. Check that the HPU is running and confirm pressure is present on port TP-P on the directional control manifold.

2. Check that the Hydraulic Supply High value is set accordingly for the actual hydraulic supply pressure as seen in step 1.

3. Compare the Hydraulic Supply pressure as seen on a manual gauge to the Hydraulic Supply as seen on the HMI General Setup screen. If the pressure on the HMI does not match the pump pressure on the Injector control panel, contact the manufacturer.

7.21. Injector Brake Pressure Low

Causes:

1. The injector brake pressure is below the Injector Brake Low Alarm setpoint while the Mill-Right is enabled.

2. The injector brake signal is missing. If the signal is missing the Injector Brake Signal Missing alarm will trigger. Check the following in the troubleshooting guide below.

Troubleshooting:

1. Check that the HPU is running and confirm pressure is present on the injector brake.

2. Check that the Injector Brake value is set accordingly for the actual injector brake pressure as seen in step 1.

3. Compare the Injector Brake pressure as seen on injector control panel to the Injector Brake as seen on the HMI General Setup screen. If the pressure on the HMI does not match the injector brake pressure on the Injector control panel, contact the manufacturer.

7.22. Chain Tension Pressure Low

Causes:

1. The chain tension pressure is below the Chain Tension Low Alarm setpoint while the Mill-Right is enabled.

2. The chain tension signal is missing. If the signal is missing the Chain Tension Signal Missing alarm will trigger at the same time and that alarm should be troubleshot before this alarm.

Troubleshooting:

1. Check that the HPU is running and confirm pressure is present on the chain tension circuit.

2. Check that the Chain Tension value is set accordingly for the actual chain tension pressure as seen in step 1.

3. Compare the Chain Tension pressure to the chain tension pressure as seen on the HMI General Setup screen. If the pressure on the HMI does not match the actual chain tension pressure, contact the manufacturer.

7.23. Skate Pressure Low

Causes:

1. The skate pressure is below the Skate Low Alarm setpoint while the Mill-Right is enabled.

2. The skate signal is missing. If the signal is missing the Skate Signal Missing alarm will trigger at the same time and that alarm should be troubleshot before this alarm.

Troubleshooting:

1. Check that the HPU is running and confirm pressure is present on the skate circuit.

2. Check that the Skate value is set accordingly for the actual skate pressure as seen in step 1.

3. Compare the actual Skate pressure to the skate pressure seen on the HMI General Setup screen. If the pressure on the HMI does not match the actual skate pressure, contact the manufacturer.

8.0 Troubleshooting 8.1. HMI Panel Not Coming On

1. Check that cable JK-HMI01 coming out of the Main Control Panel is in good condition and attached to the HMI panel.

2. Check that PL-RMC01 coming out of the main panel is plugged into a live electrical outlet and wired up to power supply in the Main Control Panel.

3. Open the Main control panel and check that CB1-6A is closed.

4. Check that the power supply "DC OK" light is on.

[0700] 5. Check that CB3-2A is closed.

6. Contact the manufacturer.

8.2. Mill-Right Enabled and Milling Sequence Started but Injector doesn't Move

1. Open the Main control panel and check that CB8-2A is closed.

2. Check that the light on relay DR1 is on indicating the relay is active.

3. Check the cable run JK-JB01 from the Main Control Panel is in good condition and is plugged into the Injector Junction Box.

4. Check that cable JK-EVD01 from the Injector junction box is in good condition and plugged into the directional control valve.

5. Check that the LED on the DIN connector at the directional valve EVD01 is On.

6. Contact Manufacturer.

8.3. ROP (Speed) or Injector Depth on HMI Not Tracking

1. Check the cable run JK-JB01 from the Main Control Panel is in good condition and is plugged into the Injector Junction Box.

2. Check that cable JK-ZIT01 from the Injector junction box is in good condition and plugged into the encoder.

3. Check that the Encoder is in good condition and securely mounted to the Injector.

4. Contact Manufacturer.

9.0 Hydraulic Control

The high response hydraulic proportional valve 35 will receive an analog and direction signal from the motion controller 65 through closed loop control to vary the flow of oil from the hydraulic motor 25. This will increase or decrease the lowering speed of the injector motor 25 during the Milling process. When the Mill-Right system 10 is turned off or shuts down, the hydraulic proportional 35 and directional valves 45 will close to ensure the cylinders of the hydraulic motors 25 hold position.

While in Mill-Right mode the injector motors 25 are isolated from the closed loop by means of venting the main counterbalance valve 40 pilot port which essentially keeps them in the closed position. At this time separate pilot operated isolation valves are opened to allow supply from the high response directional control valve in order to run the injector motors 25 from the motion controller 65. In the event of a valve failure, it will default to its normal (de-energized or un-piloted) state which is the injector normal running condition.

10.0 Major Hydraulic Components 10.1. Directional Control Manifold 30 Function:

The Directional Control Manifold 30 is the Mill-Right's main control valve; operating the Injector in Mill-Right Mode.

Location:

The Directional Control Manifold is located on the injector 15, 1.5*m* above the stripper head.

Components:

Check Valve

Solenoid Valve

Proportional Valve 35

Pilot Operated Directional Valve

Atmospheric relief valve

Accumulator Bleed Valve

How it Works: Refer to schematic ART P/N: 2000-0957 for tag reference

Accumulator (MC01) and check valve (VC02) at the inlet port ensure a consistent "Mill-Right" system pressure while still being able to use other open loop functions. When in Automatic Milling mode; the solenoid operated valve (EVD01) supplies pilot oil for all required isolating/de-isolating control valves. When the Mill-Right is off; all pilots are vented to tank via port T1. The Proportional Directional Valve (EVP01) provides the directional and speed control for the injector while in Auto-Milling mode and is operated by the motion controller constantly maintaining specified Milling parameters based on feedback from the sensors monitoring WOB, ROP and Circulation ΔP.

10.2. Load Holding Manifold

Figure 17:
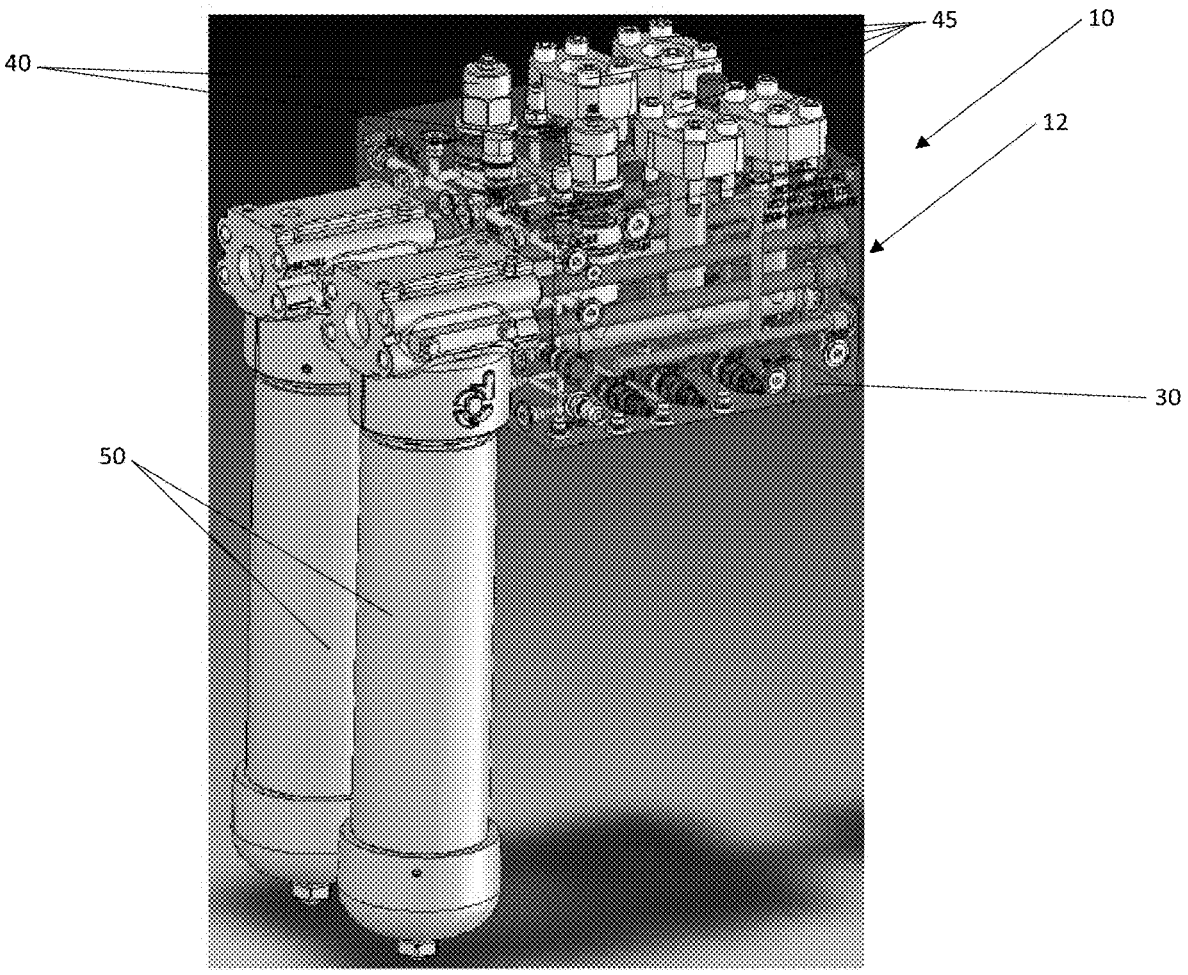
FIG. 17 depicts load holding manifold of the mill-right system.

Function:

The Load Holding manifold replaces the existing load holding manifold(s) and is modified to accept the supply from the Mill-Right Directional Manifold. Also, the load holding manifold has the added valving required for the "Brake Stand" function as well as provides a fixed mounting point for the existing closed loop filters. The existing brake control circuit has been incorporated in the manifold and is changed slightly from conventional injector brake control circuits. For functional descriptions refer to Mill-Right system overview and the hydraulic schematics. FIG. 17.

Location:

The Load holding manifold is located behind the filter assemblies and is mounted to the injector frame 17.

Components:

Load Holding (Counter Balance) valves

Brake control valves

Mill-Right Isolation Valves 11.0 Valve & Hydraulic System Safety

If the proportional valve at any time malfunctions (hydraulically or electrically) the monitoring system will shut down and engage the brake in order to stop & hold tubing position. If there is any sudden pressure drops or valve malfunctions the system will recognize them and shut down quickly and safely. When faulty values in any of these conditions are seen the control system will shut down and the operator will be notified by a buzzer & alarm messages via the HMI Panel.

NOTE: This will be a hard stop programmed from Motion Controller.

IMPORTANT: Prior to doing system maintenance; do not unhook ANY hoses UNLESS the charged accumulator is bled off. Even when the Auto Miller is shut off, the accumulator is charged with 3000 psi of hydraulic pressure. If not properly bled off, pressurized fluid can cause personal injury.

Prior to system maintenance and after shutting down the Mill-Right; the operator must bleed off the accumulator to prevent any serious damage or injuries.

Figure 18:
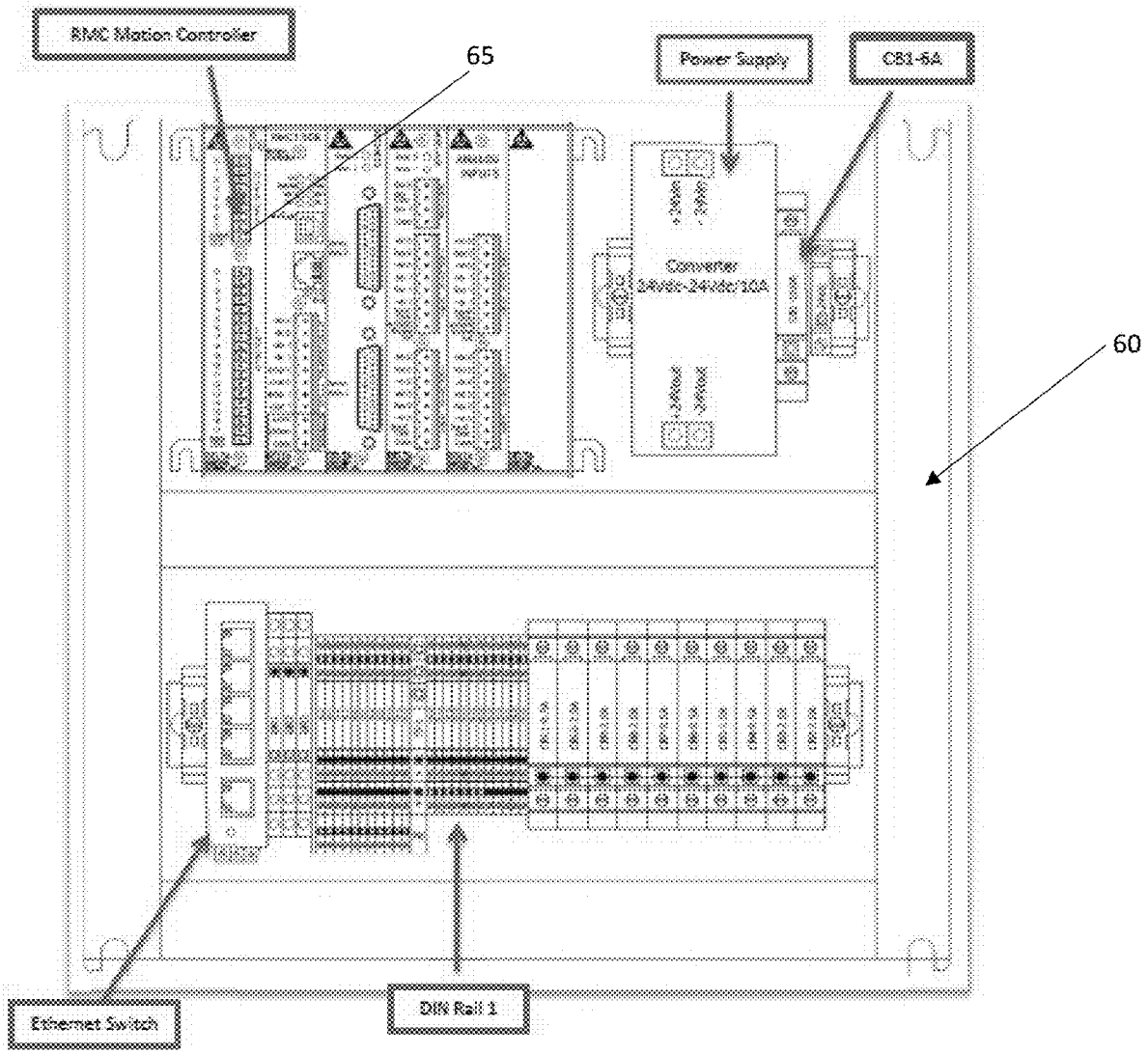
FIG. 18 depicts the motion control panel of the mill-right system.
Figure 19:
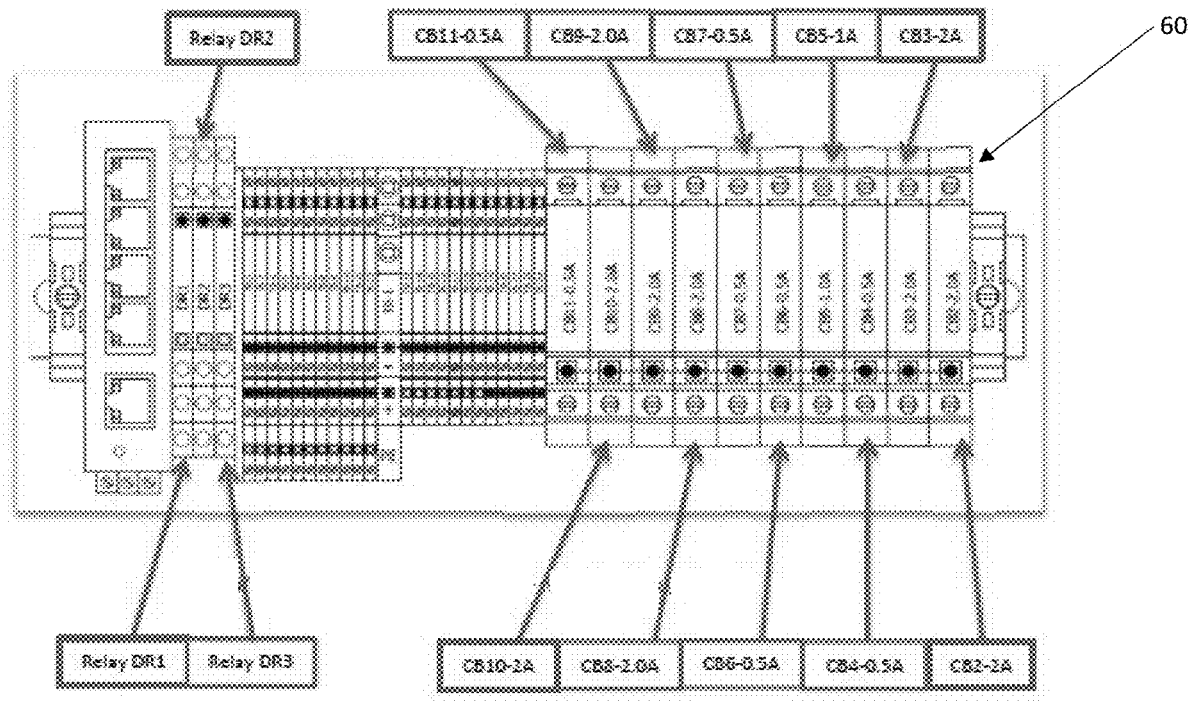
FIG. 19 depicts the DIN Rail 1 in the motion control panel of the mill-right system.
Figure 20:
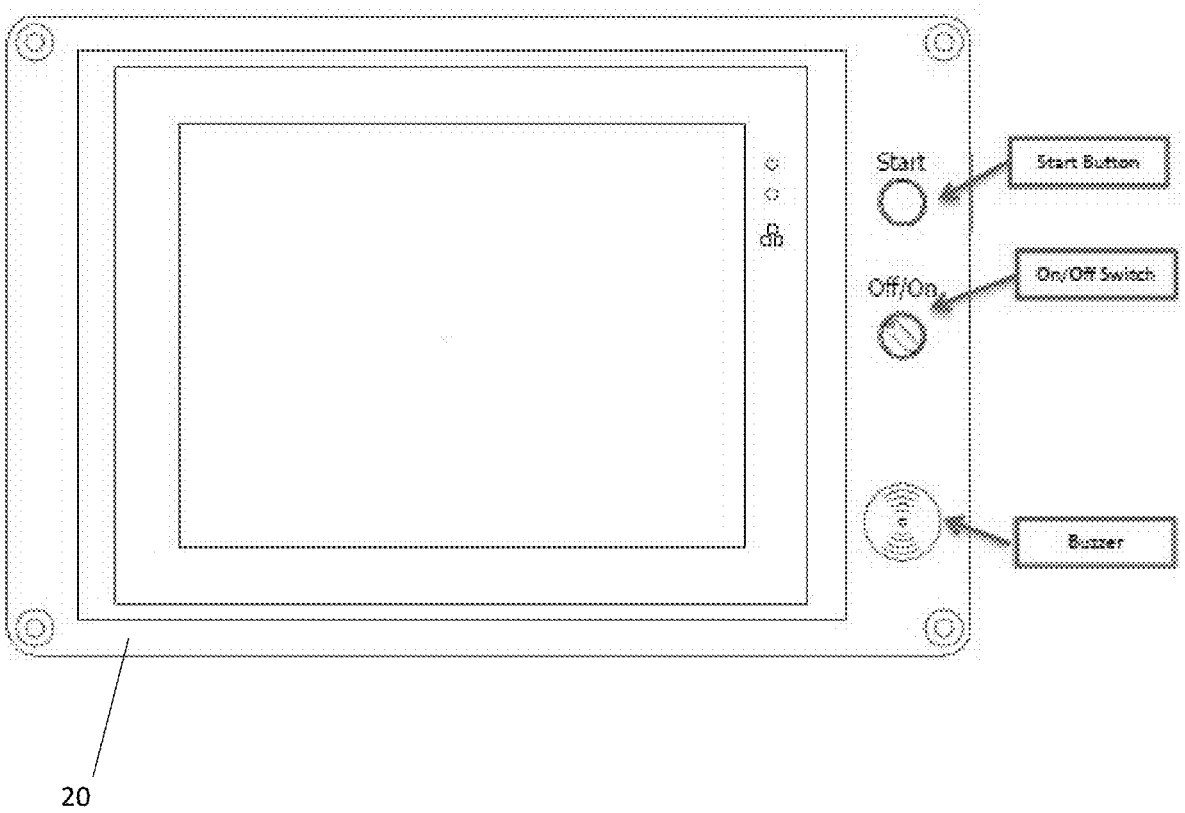
FIG. 20 depicts the HMI panel of the mill-right system.

1. Make sure that the Mill-Right & hydraulic system is shut off
2. Locate the accumulator Bleed Off Valve
3. Open the valve
4. Check pressure gauge until it's discharged (install if needed at port TP-P test point coupler)
5. Close the valve 12.0 Major Electrical Components 12.1. Mill-Right Panel (FIGS. 18 and 19)

Function:

The motion controller's 65 primary function is to "close the loop" between the measured output of the injector motor 25 and the valve supplying it. Analog inputs from multiple sensors are interpreted and used to adjust analog inputs to safely control the Injector motors 25.

Location:

The motion controller 65 is located in the panel #1000-0201 and this panel is located in the command center.

How it Works:

The Motion Controller 65 accepts signal inputs from the Load cell, Injector encoder 75, circulation pump pressure transducer, Injector brake pressure transducer, Chain tension pressure transducer, and Skate pressure transducer. The motion controller 65 continuously monitors these sensors & compares them to the user set points and controls output signal to the proportional control valve (EVP01) accordingly. FIG. 18.

1. DIN Rail 1 details below
2. CB1-16A is the main breaker for the 24 Vdc power. FIG. 19.
1. Relay DR1 is the relay that controls the signal sent to the directional valve EVD01.
2. Relay DR2 is the relay that controls the power sent to the proportional valve 35 (EVP01).
3. Relay DR3 is the relay that controls the signal sent to the brake stand valve EVD02.
4. CB2-2A is the breaker for the RMC Motion Controller 65.
5. CB3-2A is the breaker for the HMI panel 20.
6. CB4-0.5A is the breaker for the Ethernet switch.
7. CB5-1A is the breaker for the power to the Injector junction box and the sensors.
8. CB6-0.5A is the breaker feeding the digital outputs on the RMC controller 65.
9. CB7-0.5A is the breaker for the power to Digital Input in the Injector Control Panel.

12.2. HMI Panel 20

Function:

To display relevant data to the operator and allow for the operator to input setting, enable and start the Mill-Right system.

Location:

The HMI is located in the command center.

FIG. 20 HMI Panel.

How it Works:

The HMI 20 receives power from the Motion Control panel as well as communicates with the Motion Controller 65 over Modus TCP/IP via on Ethernet cable. The HMI panel 20 is used to select the desired set points by the operator and to alert the operator of potential errors.

12.3. Injector Junction Box

Function:

The Junction box takes the cables from multiple input and output devices on the Injector and puts all the signals into a single cable for the cable run back to the Motion Control Panel.

Injector Junction Box Panel 13.0 Conversions

The metric system has been used in calculations within the control system however units will be displayed in metric or imperial on the HMI based upon the unit General Setup in the HMI. Conversion factors from metric to imperial units shown below.

1 meter (m)=3.28 Feet (ft)
1 ft=0.3048 m
1 Dekanewton (daN)=2.248 pounds-force (lbf)
1 lbf=0.445 daN
1 Kilopascal (kPa)=0.145 pound force/square inch (PSI)
1 PSI=6.895 kPa
1 lb/ft=1.488 kg/m NOTE: All motion control scaling will be done in imperial units (ft/inches/lbs) and a conversion button in the setup screen on the HMI will allow the operator to swap between units. It is not password protected.

14.0 Service & Maintenance 14.1. Hydraulic Components

Must check all 5 pressure transducers (oil supply pressure, circulation pump pressure, injector brake pressure, chain tension pressure and skate pressure) and 1 load cell must be calibrated yearly.

Must check the accumulator charge (1800 nitrogen-precharge) in the system every 3 months.

Must change filters at same interval as rig filter changes.

Must check daily for pressure drop indicator while Auto-Milling is operating. Change filter if pressure drop indicator is tripped.

Must calibrate and check the pressure relief functions yearly at the Rod End Manifold.

14.2. Electrical Components

Breakers should be checked once a week in the motion control panel to ensure they have not opened.

Check all connectors, cables and wiring once a week to make sure they are properly hooked up, secured, tightened etc.

Check for damages such as wear and tear or cuts on the cables. If damage is seen, immediately replace the cable.

If any of the devices (pressure transducers, motion controller, encoder, HMI etc) are not properly working; they must be calibrated or replaced.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

I claim:

1. An apparatus for improving drilling performance of a coiled-tubing system during milling, wherein the coiled-tubing system includes an injector coupled to a pair of hydraulic motors and a drill bit coupled to a length of coiled tubing that is movable coupled to the injector, the apparatus comprising:

at least one closed loop electro-proportional valve coupleable to the pair of hydraulic motors;

at least one solenoid valve; configured to enable the apparatus;

at least five cartridge valves coupled to the solenoid valve;

at least one small pressure filter configured to filter a supply of hydraulic fluid within the apparatus; and at least three pressure feedback devices;

and a motion controller coupled to the closed loop electro-proportional valve, to the at least three pressure sensors, and to a human-machine interface;

wherein software is configured to receive and transmit data between the closed loop electro-proportional valve, the motion controller, the at least three pressure sensors, and the human-machine interface;

wherein the apparatus performs at least one selected from the group consisting of controlling a weight on a drill bit, controlling a rate of penetration of the drill bit, and controlling a differential pressure.

2. The apparatus of claim 1 wherein the closed loop electro-proportional valve controls the hydraulic motors while milling.

3. The apparatus of claim 1 wherein the at least five cartridge valves isolate the apparatus.

4. The apparatus of claim 1 wherein the at least three pressure feedback devices are transducers mounted remotely from a manifold, and wherein the apparatus is housed within the manifold.

5. The apparatus of claim 1 wherein a manifold is mounted to an injector frame of the injector, wherein the apparatus is housed within the manifold.

6. The apparatus of claim 1 further comprising bulkhead provisions for pressure supply and low pressure return for the control manifold; a pressure filter to protect against contamination; at least one small accumulator; plumbing remote mounted from manifold; a wiring harness from a human-machine interface to a injector junction box; and wiring from the injector junction box to devices.

7. A method of improving drill performance of a coiled-tubing system during milling, wherein the coiled-tubing system includes an injector coupled to a pair of hydraulic motors and a drill bit coupled to a length of coiled tubing that is movable coupled to the injector, using the apparatus of claim 1, the method comprising:

wherein the rate of penetration of the drill bit is controlled;

wherein the weight on the drill bit is controlled;

wherein the differential pressure across a well head is controlled;

wherein the drill bit is a milling drill bit;

wherein an output to the proportional valve is adjusted to provide control of the pair of hydraulic motors.

8. The method of claim 7 further comprising moving the drill bit to a bottom of a hole.

9. The method of claim 7 further comprising setting maximum values for the weight on the drill bit, the rate of penetration, and the differential pressure.

10. The method of claim 9 wherein the apparatus shuts down if any of the maximum values are exceeded.

11. The method of claim 7 wherein controlling the weight on the drill bit, controlling the rate of penetration of the drill bit, and controlling the differential pressure are performed simultaneously.

12. The method of claim 7 wherein two of the group consisting of controlling the weight on the drill bit, controlling the rate of penetration of the drill bit, and controlling the differential pressure are activated simultaneously.

13. The method of claim 7 wherein the apparatus is installed on the injector.

14. The method of claim 7 wherein an operator selects a milling mode with the human-machine interface.

15. The method of claim 7 wherein the rate of penetration of the drill bit is controlled by adjusting a flow rate by adjusting a swash plate in the hydraulic motors to allow an injector drive chain to speed up.

16. The method of claim 7 wherein a hydraulic pressure is adjusted to control the weight on the bit.

* * * * *